US006210871B1

(12) United States Patent
Ishii et al.

(10) Patent No.: US 6,210,871 B1
(45) Date of Patent: Apr. 3, 2001

(54) SILVER HALIDE COLOR PHOTOGRAPHIC LIGHT-SENSITIVE MATERIAL

(75) Inventors: Yoshio Ishii; Yoshiharu Yabuki, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/009,773

(22) Filed: Jan. 20, 1998

(30) Foreign Application Priority Data

Jan. 20, 1997 (JP) ..... 9-019591

(51) Int. Cl.[7] ..... G03C 1/12; G03C 1/14; G03C 1/20

(52) U.S. Cl. ..... 430/584; 430/567; 430/30; 430/517; 430/522; 430/507; 430/944

(58) Field of Search ..... 396/567; 430/30, 430/517, 522, 507, 584, 944

(56) References Cited

U.S. PATENT DOCUMENTS 5,449,594 * 9/1995 Ueda et al. ..... 430/522

FOREIGN PATENT DOCUMENTS

0703494 A1 9/1995 (EP) .
4-180057 * 6/1992 (JP) .

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide color photographic light-sensitive material having at least one red-sensitive silver halide emulsion layer, at least one green-sensitive silver halide emulsion layer, at least one blue-sensitive silver halide emulsion layer and at least one nonlight-sensitive hydrophilic colloid layer containing black colloidal silver, on a support, contains a dye whose maximum absorption in the wavelength range of 400 nm to 1100 nm is given at a wavelength in an infrared region of 700 nm to 1100 nm, contains 3.2 g/m$^2$ or less of silver in terms of silver, and has a transmission density of 1.7 or more at 950 nm.

22 Claims, No Drawings

SILVER HALIDE COLOR PHOTOGRAPHIC LIGHT-SENSITIVE MATERIAL

BACKGROUND OF THE INVENTION

The present invention relates to a silver halide color photographic light-sensitive material. More particularly, it relates to a silver halide color photographic light-sensitive material which has a small a change of photographic performance during running processing, which is excellent in sharpness and whose feedability in, for example, a camera or an automatic developer is improved.

It is strongly demanded that the silver halide color photographic light-sensitive material (hereinafter also referred to simply as "light-sensitive material"), especially, that for photography not only have an excellent image quality but also constantly exhibit stable photographic performance when subjected to, for example, color development.

Japanese Patent Application KOKAI Publication No. (hereinafter referred to as JP-A-) 4-273900 proposed a light-sensitive material containing a developer-deactivating type timing DIR compound, in which the total coating amount of silver ranges from 1.0 to 4.0 g/m$^2$, as means for constantly obtaining stable photographic performance when subjected to color development.

Although the use of this light-sensitive material significantly reduces the change of photographic performance even in low replenishing processing, further improvement has been desired. In particular, when a running processing is carried out for a prolonged period of time, photographic performance changes, especially, performance changes of yellow, magenta and cyan dye images occur with different intensities to thereby invite a collapse of color balance, so that an improvement has been desired.

JP-A-8-179460 proposed a light-sensitive material wherein the total coating amount of silver is 3.2 g/m$^2$ or less in terms of metallic silver and which has a specified infrared reflectance at 750 nm as means for improving the feeding performance (hereinafter referred to as feedability) of the light-sensitive material in cameras, sharpness and performance to desilver (hereinafter referred to as desilverability).

Although the use of this light-sensitive material is effective in improving the feedability of the light-sensitive material in cameras, sharpness and desilverability, further improvement has been desired in respect of the photographic property changes during the running processing. Moreover, the failure to conduct accurate feeding occurred although in extremely low frequency, depending on the type of employed camera, so that further improvement has been desired.

For example, increasing the coating amount of black colloidal silver in the antihalation layer can be thought of for increasing the infrared transmission density at 950 nm of the light-sensitive material. However, when the coating amount of black colloidal silver of the antihalation layer is increased, it occurs that photographing of a date and time by an exposure from a side of the support opposite the side coated with the silver halide emulsion layer, i.e., from a back side, is difficult, so that an improvement has been desired.

JP-A-62-299959 proposed the addition of an infrared absorbing component to at least one layer disposed on a side of a support opposite the side coated with an emulsion layer.

However, this proposed method is likely to cause extreme changes of photographic properties while the light-sensitive material is stored in the state of being rolled in a patrone, so that an improvement has been desired.

Moreover, JP-A-8-95198 proposed a method comprising detecting with the use of a light receiving device a decrease of the quantity of infrared rays transmitted through a light-sensitive material. In JP-A-8-95198, it is disclosed that the coating amount of silver of 4.0 g/m$^2$ or less, the light-sensitive material having a layer containing a metal oxide and capable of reflecting infrared rays and transmitting visible light to thereby determine the presence of a silver halide light-sensitive material.

Although this method enables easily detecting the light-sensitive material, an improvement of the method has been desired in respect of the storage of the light-sensitive material.

BRIEF SUMMARY OF THE INVENTION

Therefore, an object of the present invention is to provide a silver halide color photographic light-sensitive material which is small in changes of photographic performance in a running processing, which is improved in the feedability in, for example, an automatic developing machine and which is excellent in the storage stability.

It is another object of the present invention to provide a photographic material on which information such as date and time can be recorded clearly.

DETAILED DESCRIPTION OF THE INVENTION

The inventors have found that when the coating amount of silver is small as described in JP-A-4-273900, continuation of a running processing by means of an automatic developing machine leads to a failure of the automatic developing machine in detecting the light-sensitive material to thereby disenable appropriate replenishing so as to bring about changes of photographic properties.

The following silver halide color photographic light-sensitive material has solved this problem.

That is, according to the present invention, there is provided a silver halide color photographic light-sensitive material comprising a support and, superimposed thereon, at least one red-sensitive silver halide emulsion layer, at least one green-sensitive silver halide emulsion layer, at least one blue-sensitive silver halide emulsion layer and at least one nonlight-sensitive hydrophilic colloid layer containing black colloidal silver, said light-sensitive material contains a dye whose wavelength at which an absorption maximum is given from 700 to 1100 nm is in an infrared region of 700 to 1100 nm, the coated amount of silver halide and colloidal silver of said light-sensitive material is 3.2 g/m$^2$ or less in terms of silver, and -;said light-sensitive material has a transmission density of 1.7 or more at 950 nm.

Hereinafter the dye used in the light-sensitive material of the invention is also referred to as an infrared absorbing dye.

The infrared absorbing dye has an absorption characteristics that the wavelength at which a maximum absorption (hereinafter also referred to as $\lambda$max) is given, exists in the range of 700 nm to 1100 nm when the absorption of the dye is measured from 400 nm to 1100 nm. This absorption characteristic refers to that exhibited by the infrared absorbing dye in the state that the dye is present in the light-sensitive material. The state of the dye in the light-sensitive material may be a solution state, an emulsified dispersion state or a solid dispersion state. The absorption at the wavelength from 400 nm to 1100 nm is one fifth or less of the maximum absorption.

The infrared absorbing dye preferably used in the present invention is a cyanine dye represented by the following formula (I).

(I)

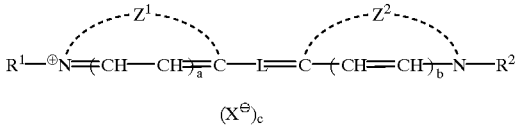

In the formula (I), $Z^1$ and $Z^2$ each independently represent nonmetallic atom groups forming five-membered or six-membered nitrogen-containing heterocycles which may undergo ring condensation. Examples of the nitrogen-containing heterocycles and condensed rings therefrom include an oxazole ring, an isoxazole ring, a benzoxazole ring, a naphthoxazole ring, a thiazole ring, a benzothiazole ring, a naphthothiazole ring, an indolenine ring, a benzindolenine ring, an imidazole ring, a benzimidazole ring, a naphthimidazole ring, a quinoline ring, a pyridine ring, a pyrrolopyridine ring, a furopyrrole ring, an indolizine ring, an imidazoquinoxaline ring and a quinoxaline ring. Five-membered nitrogen-containing heterocycles are preferred to six-membered nitrogen-containing heterocycles. Five-membered nitrogen-containing heterocycles fused with a benzene or naphthalene ring are more preferred, and indolenine and benzindolenine rings are most preferred.

Each nitrogen-containing heterocycle or ring fused therewith may have one or more substituents. Examples of the substibuents include alkyl groups having 1 to 10 carbon atoms, preferably, 1 to 6 carbon atoms (including linear, branched, cyclic, substituted and unsubstituted groups (applicable hereinafter), e.g., methyl, ethyl, propyl, butyl, isobutyl, pentyl and hexyl), alkoxy groups having 1 to 10 carbon atoms, preferably, 1 to 6 carbon atoms (e.g., methoxy and ethoxy), aryloxy groups having 6 to 20 carbon atoms, preferably, 6 to 12 carbon atoms (e.g., phenoxy and p-chlorophenoxy), halogen atoms (Cl, Br and F), alkoxycarbonyl groups having 10 or less carbon atoms, preferably, 6 or less carbon atoms (e.g., ethoxycarbonyl), cyano, nitro and carboxyl. The carboxyl may form a salt in cooperation with a cation. Also, the carboxyl may form an intramolecular salt together with $N^+$. Preferred substituents are chlorine atom (Cl), methoxy, methyl and carboxyl. When the nitrogen-containing heterocycle is substituted with a carboxyl, dispersing into solid fine grains brings about a conspicuous shift of the maximum absorption wavelength toward a large wavelength side. However, the carboxyl substituted compound is hydrophilic and is easily leached into a processing solution. The lake formation described later is effective in preventing the removal of the carboxyl substituted compound by the processing solution. Moreover, introduction of a phenyl group or an alkyl group having at least 3 carbon atoms into $R^1$, $R^2$ or L of the formula (I) is effective in preventing the leaching into the processing solution.

On the other hand, with respect to a compound having no carboxyl, it is preferred that the dispersion time spent in the preparation of solid fine grains be prolonged for promoting a shift of the maximum absorption wavelength thereof toward a large wavelength side within the range of 50 nm to 200 nm. The compound represented by the formula (1c) shown later is especially preferred as the compound having no carboxyl.

In the formula (I), each of $R^1$ and $R^2$ independently represents an alkyl group, an alkenyl group or an aralkyl group. An alkyl group is preferred, and an unsubstituted alkyl group is more preferred.

The number of carbon atoms of the alkyl group is preferably 1 to 10 and more preferably 1 to 6. Examples of the alkyl groups include methyl, ethyl, propyl, butyl, isobutyl, pentyl and hexyl. The alkyl group may have one or more substituents. Examples of the substibuents include halogen atoms (Cl, Br and F), alkoxycarbonyl groups having 2 to 10 carbon atoms, preferably, 2 to 6 carbon atoms (e.g., methoxycarbonyl and ethoxycarbonyl) and hydroxyl.

The number of carbon atoms of the alkenyl group is preferably 2 to 10 and more preferably 2 to 6. Examples of the alkenyl groups include 2-pentenyl, vinyl, allyl, 2-butenyl and 1-propenyl. The alkenyl group may have one or more substituents. Examples of the substibuents include halogen atoms (Cl, Br and F), alkoxycarbonyl groups having 2 to 10 carbon atoms, preferably, 2 to 6 carbon atoms (e.g., methoxycarbonyl and ethoxycarbonyl) and hydroxyl.

The number of carbon atoms of the aralkyl group is preferably 7 to 12. Examples of the aralkyl groups include benzyl and phenetyl. The aralkyl group may have one or more substituents. Examples of the substibuents include halogen atoms (Cl, Br and F), alkyl groups having 1 to 10 carbon atoms, preferably, 1 to 6 carbon atoms (e.g., methyl) and alkoxy groups having 1 to 10 carbon atoms, preferably, 1 to 6 carbon atoms (e.g., methoxy).

In the formula (I), L represents a connecting group in which 5, 7 or 9 methine groups are bonded with each other so that the double bonds conjugate with each other. The number of methine groups is preferably 7 (heptamethine compound) or 9 (nonamethine compound) and more preferably 7.

Each methine group may have one or more substituents. However, preferably, the methine group having a substituent is one positioned in the middle (meso position) of the connecting group. The substituent of the methine group will be described with reference to the following formulae L5 (pentamethine), L7 (heptamethine) and L9 (nonamethine).

(L5)

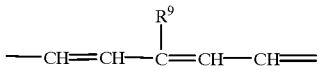

(L7)

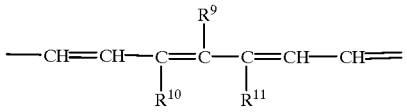

(L9)

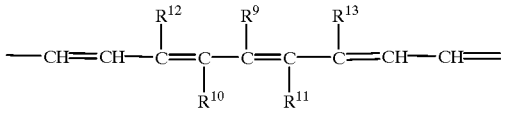

In the formulae L5, L7 and L9, $R^9$ represents a hydrogen atom, an alkyl group, a halogen atom, an aryl group, $—NR^{14}R^{15}$ (wherein $R^{14}$ represents an alkyl or aryl group and $R^{15}$ represents a hydrogen atom, an alkyl group, an aryl group, an alkylsulfonyl group, an arylsulfonyl group or an acyl group or $R^{14}$ and $R^{15}$ are bonded with each other to form a five-membered or six-membered nitrogen-containing heterocycle together with N), an alkylthio group, an arylthio group, an alkoxy group or an aryloxy group; each of $R^{10}$ and $R^{11}$ is independently a hydrogen atom or $R^{10}$ and Rll bond, together with C═C—C, to form a five-membered or six-membered ring; and each of $R^{12}$ and $R^{13}$ independently represents a hydrogen atom or an alkyl group.

$R^9$ preferably represents —$NR^{14}R^{15}$, in which at least one of $R^{14}$ and $R^{15}$ is preferably phenyl.

It is preferred that $R^{10}$ and $R^{11}$ be bonded with each other to form a five-membered or six-membered ring. When $R^9$ represents a hydrogen atom, the formation of the ring is especially preferred. Cyclopentene and cyclohexene rings can be mentioned as examples of the rings formed by $R^{10}$ and $R^{11}$. The rings formed by $R^{10}$ and $R^{11}$ may have one or more substituents. Examples of the substibuents include alkyl and aryl groups.

The number of carbon atoms of the alkyl group represented by the above $R^9$, $R^{12}$, $R^{13}$, $R^{14}$ or $R^{15}$ and the alkyl group which may be possessed by the ring formed by $R^{10}$ and $R^{11}$ is preferably 1 to 10 and more preferably 1 to 6. Examples of the alkyl groups include methyl, ethyl, propyl, butyl, isobutyl, pentyl and hexyl. The alkyl group may have one or more substituents. Examples of the substibuents include halogen atoms (Cl, Br and F), alkoxycarbonyl groups having 2 to 10 carbon atoms, preferably, 2 to 6 carbon atoms (e.g., methoxycarbonyl and ethoxycarbonyl) and hydroxyl.

The halogen atom represented by the above $R^9$ is, for example, a fluorine atom, a chlorine atom or a bromine atom.

The number of carbon atoms of the aryl group represented by the above $R^9$, $R^{14}$ or $R^{15}$ is preferably 6 to 12. Examples of the aryl groups include phenyl and naphthyl. The aryl group may have one or more substituents. Examples of the substituents include alkyl groups having 1 to 10 carbon atoms, preferably, 1 to 6 carbon atoms (e.g., methyl, ethyl, propyl, butyl, isobutyl, pentyl and hexyl), alkoxy groups having 1 to 10 carbon atoms, preferably, 1 to 6 carbon atoms (e.g., methoxy and ethoxy), aryloxy groups having 20 or less carbon atoms, preferably, 12 or less carbon atoms (e.g., phenoxy and p-chlorophenoxy), halogen atoms (Cl, Br and F), alkoxycarbonyl groups having 2 to 10 carbon atoms, preferably, 2 to 6 carbon atoms (e.g., ethoxycarbonyl), cyano, nitro and carboxyl.

The number of carbon atoms of the alkylsulfonyl group represented by the above $R^{15}$ is preferably 1 to 10. Examples of the alkylsulfonyl groups include mesyl and ethanesulfonyl.

The number of carbon atoms of the arylsulfonyl group represented by the above $R^{15}$ is preferably 6 to 10. Examples of the arylsulfonyl groups include tosyl and benzenesulfonyl.

The number of carbon atoms of the acyl group represented by the above $R^{15}$ is preferably 2 to 10. Examples of the acyl groups include acetyl, propionyl and benzoyl.

Examples of nitrogen-containing heterocycles formed, together with N, by bonding $R^{14}$ and $R^{15}$ include a piperidine ring, a morpholine ring and a piperazine ring. The nitrogen-containing heterocycle may have one or more substituents. Examples of the substibuents include alkyl groups having 1 to 10 carbon atoms (e.g., methyl), aryl groups having 6 to 12 carbon atoms (e.g., phenyl) and alkoxycarbonyl groups having 2 to 10 carbon atoms (e.g., ethoxycarbonyl).

In the formula (I), each of a, b and c is 0 or 1. Each of a and b is preferably 0. c is generally 1 although c is 0 when an anionic substituent such as carboxyl forms an intramolecular salt together with $N^+$.

In the formula (I), X represents an anion. Examples of the anions include halide ions ($Cl^-$, $Br^-$ and $I^-$), p-toluenesulfonate ion, ethyl sulfate ion, $PF_6^-$, $BF_4^-$ and $ClO_4^-$.

More preferred heptamethine cyanine dye is represented by the following formula (Ib).

(Ib)

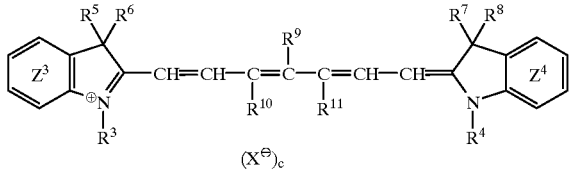

In the formula, another benzene ring may be fused with each of the benzene rings having $Z^3$ or $Z^4$ attached thereto inside the same; each of $R^3$ and $R^4$ independently represents an alkyl group, an aralkyl group or an alkenyl group; either each of $R^5$, $R^6$, $R^7$ and $R^8$ independently represents an alkyl group, or either $R^5$ and $R^6$ or $R^7$ and $R^8$ are bonded with each other, forming a five-membered or six-membered ring together with C; $R^9$ represents a hydrogen atom, an alkyl group, a halogen atom, an aryl group, —$NR^{14}R^{15}$ (wherein $R^{14}$ represents an alkyl or aryl group and $R^{15}$ represents a hydrogen atom, an alkyl group, an aryl group, an alkylsulfonyl group, an arylsulfonyl group or an acyl group, or $R^{14}$ and $R^{15}$ are bonded with each other to form a five-membered or six-membered nitrogen-containing heterocycle together with N), an alkylthio group, an arylthio group, an alkoxy group or an aryloxy group; $R^{10}$ and $R^{11}$ are independently hydrogen atoms or bonded with each other to form a five-membered or six-membered ring together with C═C—C; X represents an anion; and c is 0 or 1.

Each of the benzene rings having $Z^3$ or $Z^4$ attached thereto inside the same and the other benzene ring fused therewith may have one or more substituents. Examples of the substituents are the same as those mentioned above with regard to $Z^1$ and $Z^2$.

The number of carbon atoms, examples, possible substituents, preferred groups and more preferred groups of $R^3$ and $R^4$ are the same as those mentioned above with regard to $R^1$ and $R^2$ of the formula (I).

The number of carbon atoms, examples, possible substituents, preferred groups and more preferred groups of the alkyl group represented by each of $R^5$, $R^6$, $R^7$ and $R^8$ are the same as those mentioned above with regard to the alkyl group represented by each of $R^1$ and $R^2$ of the formula (I). A cyclohexane ring can be mentioned as an example of the ring formed by mutual bonding of either $R^5$ and $R^6$, or $R^7$ and $R^8$.

The number of carbon atoms, examples, possible substituents, preferred groups and more preferred groups of each of $R^9$, $R^{10}$ and $R^{11}$ are the same as those mentioned above with regard to each of $R^9$, $R^{10}$ and $R^{11}$ of the formula (L7).

Examples of X and general values of c are the same as those of X and c of the formula (I), respectively.

Most preferred heptamethine cyanine dye is represented by the following formula (Ic).

(Ic)

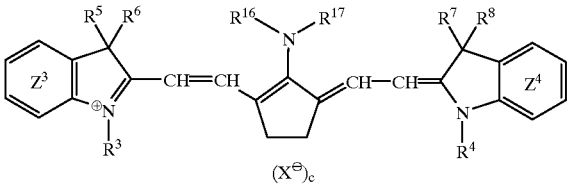

In the formula, another benzene ring may be fused with the benzene ring having $Z^3$ and $Z^4$ attached thereto inside the same; each of $R^3$ and $R^4$ independently represents an alkyl group, an aralkyl group or an alkenyl group; either each of $R^5$, $R^6$, $R^7$ and $R^8$ independently represents an alkyl group, or either $R^5$ and $R^6$, or $R^7$ and $R^8$ are bonded with each other to form a ring; each of $R^{16}$ and $R^{17}$ independently represents an alkyl group or an aryl group; X represents an anion; and c is 0 or 1.

The benzene ring having $Z^3$ and $Z^4$ attached thereto and the other benzene ring fused therewith may have one or more substituents. Examples of the substituents are the same as those mentioned above with regard to $Z^1$ and $z^2$.

The number of carbon atoms, examples, possible substituents, preferred groups and more preferred groups of each of $R^3$ and $R^4$ are the same as those mentioned above with regard to each of $R^1$ and $R^2$ of the formula (I).

The number of carbon atoms, examples, possible substituents, preferred groups and more preferred groups of the alkyl group represented by each of $R^5$, $R^6$, $R^7$ and $R^8$ are the same as those mentioned above with regard to the alkyl group represented by $R^1$ and $R^2$ of the formula (I). A cyclohexane ring can be mentioned as an example of the ring formed by mutual bonding of either $R^5$ and $R^6$, or $R^7$ and $R^8$.

The number of carbon atoms, examples, possible substituents, preferred groups and more preferred groups of the alkyl group represented by each of $R^{16}$ and $R^{17}$ are the same as those mentioned above with regard to the alkyl groups represented by each of $R^1$ and $R^2$ of the formula (I). The number of carbon atoms, examples and possible substituents of the aryl group represented by each of $R^{16}$ and $R^{17}$ are the same as those of the aryl group of each of $R^9$, $R^{14}$ and $R^{15}$ in the formulae (L5) to (L9).

Examples of X and general values of c are the same as those of X and c of the formula (I), respectively.

Examples of cyanine dyes preferably employed in the present invention are listed below.

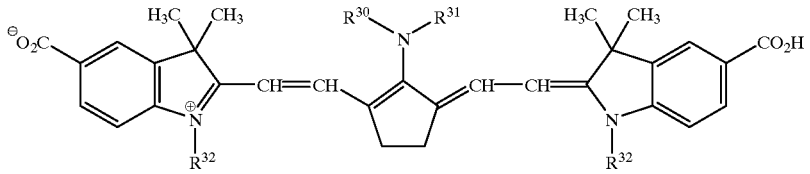

| Compound | $R^{30}$ | $R^{31}$ | $R^{32}$ |
|---|---|---|---|
| (1) | phenyl | phenyl | $CH_3$ |
| (2) | 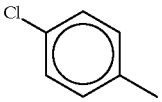 | 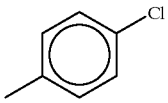 | $CH_3$ |
| (3) | phenyl | $CH_3$ | $CH_3$ |
| (4) | 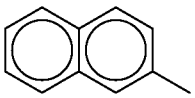 | $C_2H_5$ | $C_2H_5$ |
| (5) | $CH_3$ | phenyl | n-$C_4H_9$ |
| (6) | 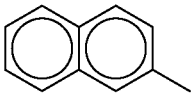 | 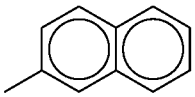 | $CH_3$ |

-continued
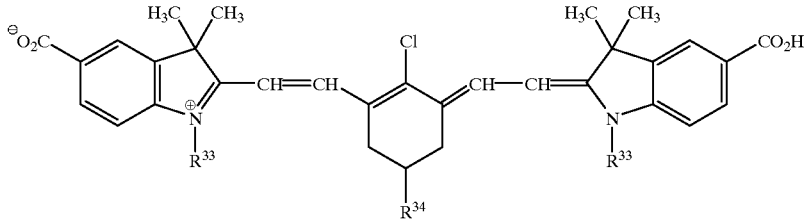
| Compound | $R^{33}$ | $R^{34}$ |
|---|---|---|
| (7) | n-$C_4H_9$ | $CH_3$ |
| (8) | n-$C_4H_9$ | t-$C_4H_9$ |
| (9) | n-$C_4H_9$ | phenyl |
| (10) | $C_3H_7$ | phenyl |
| (11) | n-$C_6H_{13}$ | t-$C_4H_9$ |
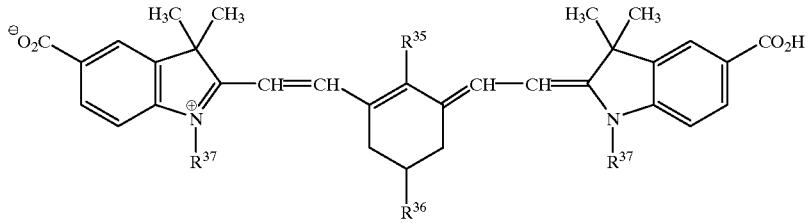
| Compound | $R^{35}$ | $R^{36}$ | $R^{37}$ |
|---|---|---|---|
| (12) | 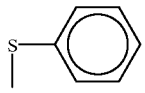 | $CH_3$ | $CH_3$ |
| (13) | 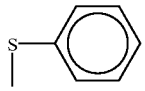 | t-$C_4H_9$ | $CH_3$ |
| (14) | 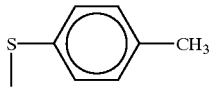 | phenyl | $CH_3$ |
| (15) | 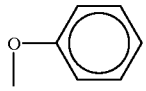 | t-$C_4H_9$ | $CH_3$ |
| (16) | 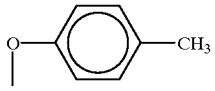 | phenyl | $CH_3$ |
| (17) | 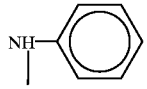 | t-$C_4H_9$ | $CH_3$ |
| (18) | 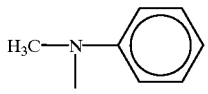 | t-$C_4H_9$ | $CH_3$ |
| (19) | phenyl | H | $C_4H_9$ |

-continued
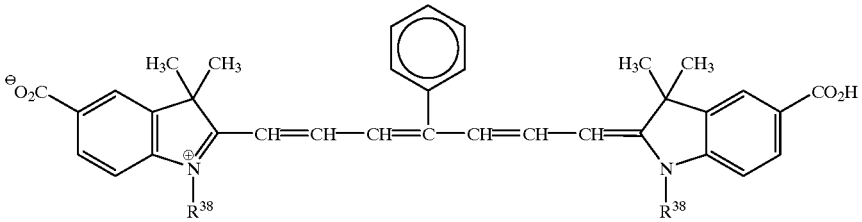
| | $R^{38}$ | | $R^{38}$ |
|---|---|---|---|
| (20) | $CH_3$ | (21) | $C_2H_5$ |
| (22) | n-$C_3H_7$ | (23) | n-$C_4H_9$ |
| (24) | n-$C_5H_{11}$ | (25) | n-$C_6H_{13}$ |
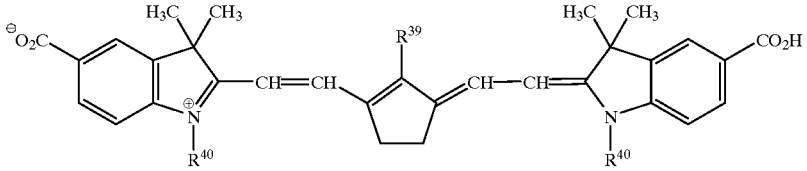
| Compound | $R^{39}$ | $R^{40}$ |
|---|---|---|
| (26) | 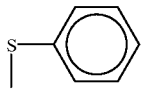 | n-$C_4H_9$ |
| (27) | 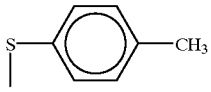 | n-$C_4H_9$ |
| (28) | 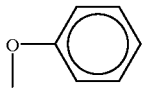 | n-$C_4H_9$ |
| (29) | 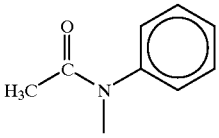 | $CH_3$ |
| (30) | 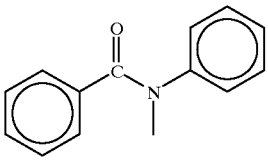 | $CH_3$ |

-continued
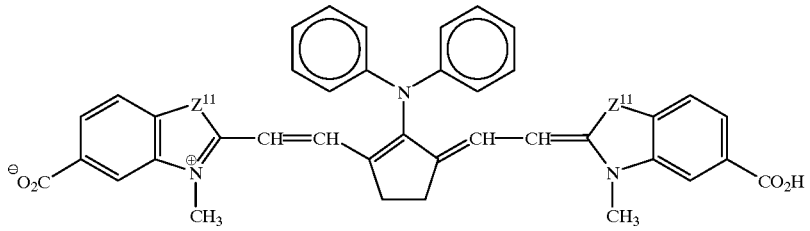
| Compound | $Z^{11}$ | Compound | $Z^{11}$ | Compound | $Z^{11}$ |
|---|---|---|---|---|---|
| (31) | O | (32) | S | (33) | 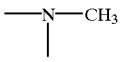 |
(34)
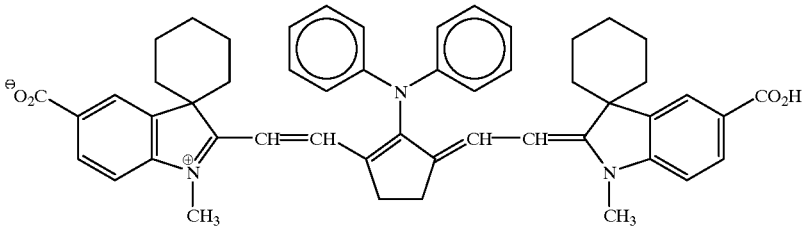
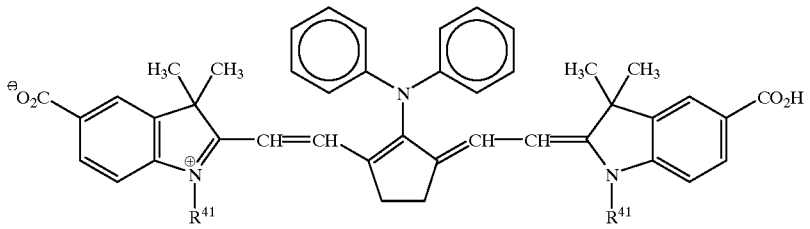
| Compound | $R^{41}$ | Compound | $R^{41}$ |
|---|---|---|---|
| (35) | 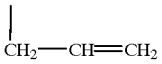 | (36) | 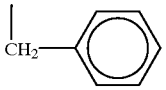 |
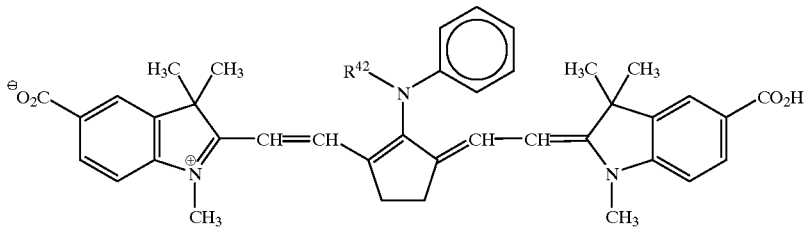
| Compound | $R^{42}$ | Compound | $R^{42}$ |
|---|---|---|---|
| (37) | 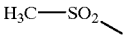 | (38) | 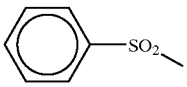 |

-continued
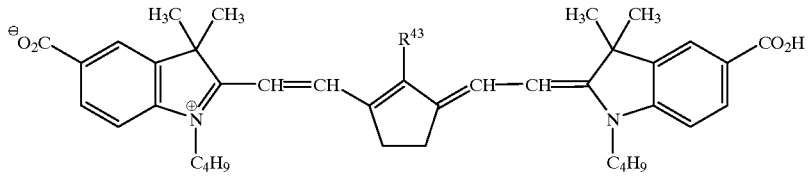
| Compound | $R^{43}$ | Compound | $R^{43}$ |
|---|---|---|---|
| (39) | 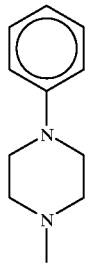 | (40) | 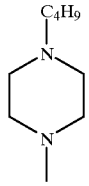 |
| (41) | 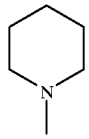 | (42) | Cl |
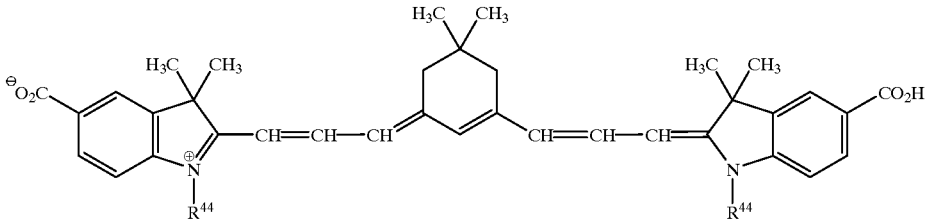
| Compound | $R^{44}$ | Compound | $R^{44}$ |
|---|---|---|---|
| (43) | $CH_3$ | (44) | $C_2H_5$ |
| (45) | n-$C_3H_7$ | (46) | n-$C_4H_9$ |
| (47) | 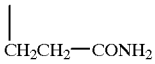 | (48) | 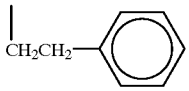 |
| (49) | 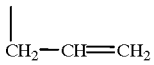 | (50) | 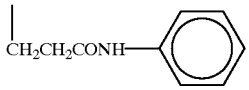 |
| (51) | 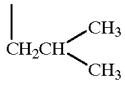 | (52) | 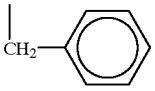 |

-continued
| Compound | $L^{11}$ |
|---|---|
| | 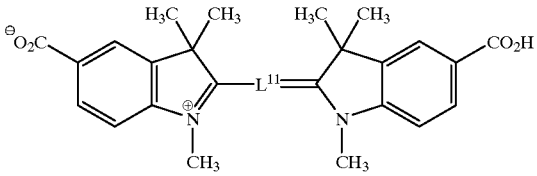 |
| (53) | 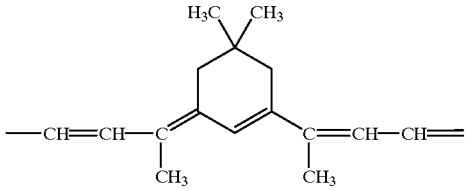 |
| (54) | 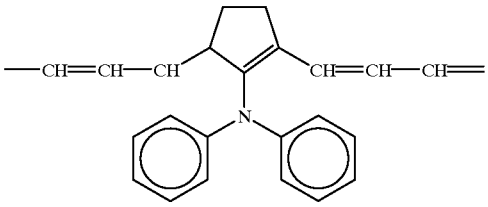 |
| (55) | 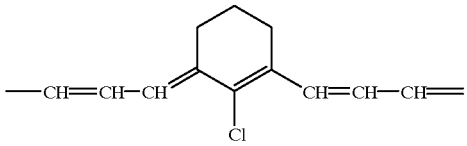 |
| Compound | $Z^{12}$ | $Z^{13}$ |
|---|---|---|
| | 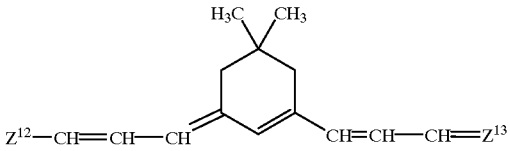 | |
| (56) | 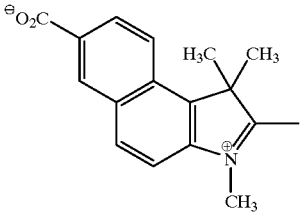 | 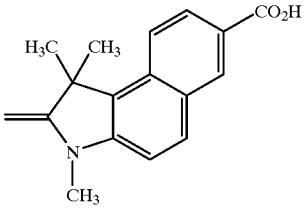 |
| (57) | 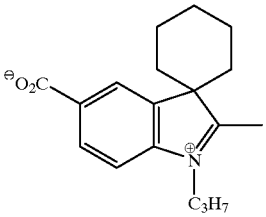 | 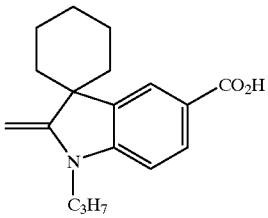 |

-continued
(58)
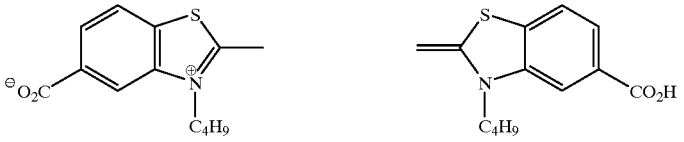
(59)
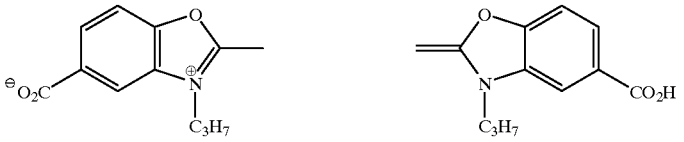
(60)
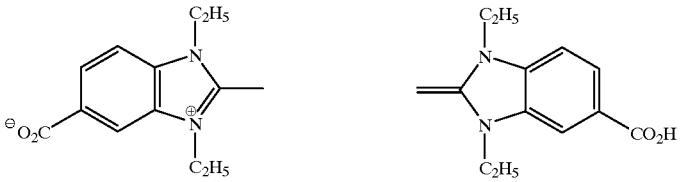
(61)
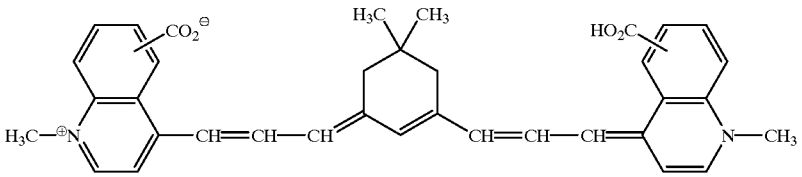
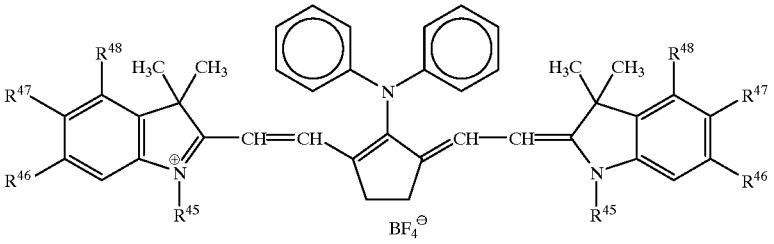
| Compound | $R^{45}$ | $R^{46}$ | $R^{47}$ | $R^{48}$ |
|---|---|---|---|---|
| (62) | $CH_3$ | H | H | H |
| (63) | $CH_3$ | H | Cl | H |
| (64) | $CH_3$ | H | $OCH_3$ | H |
| (65) | $CH_3$ | H | CN | H |
| (66) | $CH_3$ | H | $CO_2C_2H_5$ | H |
| (67) | $CH_3$ | H | $NO_2$ | H |
| (68) | $CH_3$ | H | $CH_3$ | H |
| (69) | $CH_3$ | H | Cl | Cl |
| (70) | $CH_3$ | Cl | H | Cl |
| (71) | $C_2H_5$ | H | Cl | H |
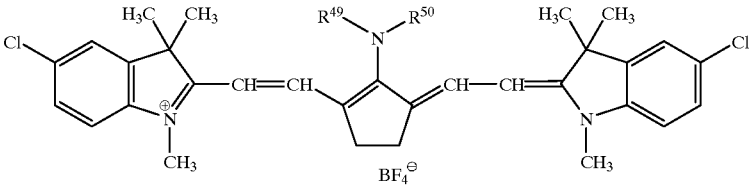
| Compound | $R^{49}$ | $R^{50}$ |
|---|---|---|
| (72) | $CH_3$ | phenyl |
| (73) | $C_2H_5$ | phenyl |

-continued
| | | |
|---|---|---|
| (74) | 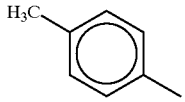 | 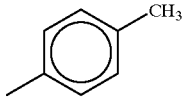 |
| (75) | 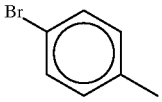 | 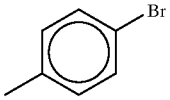 |
| (76) | 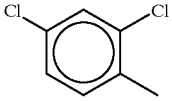 | 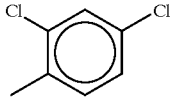 |
| (77) | 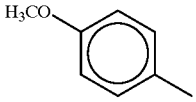 | 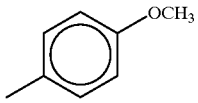 |
| (78) | 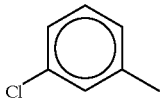 | 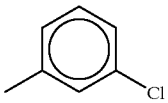 |
| (79) | $CH_3$ | $CH_3$ |
| (80) | $C_2H_5$ | $C_2H_5$ |
| (81) | $H_3C-O-\underset{\underset{O}{\parallel}}{C}-CH_2-$ | $-CH_2-\underset{\underset{O}{\parallel}}{C}-O-CH_3$ |
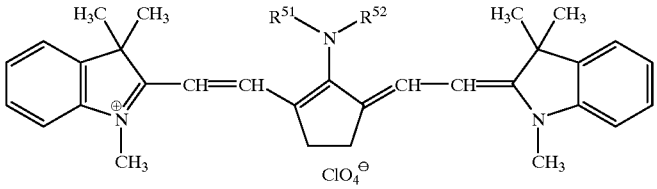
| Compound | $R^{51}$ | $R^{52}$ |
|---|---|---|
| (82) | phenyl | 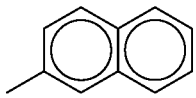 |
| (83) | phenyl | 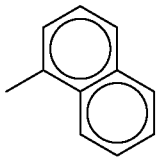 |
| (84) | 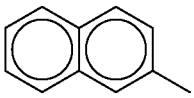 | 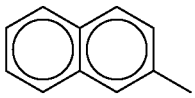 |
| (85) | $CH_3$ | 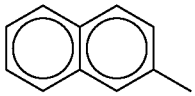 |

-continued
| | | |
|---|---|---|
| (86) | $C_4H_9$ | 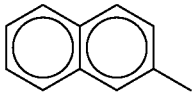 |
| (87) | phenyl | $SO_2—CH_3$ |
| (88) | phenyl | 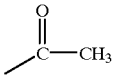 |
| (89) | phenyl | H |
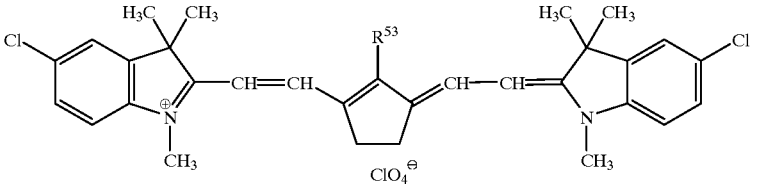
| Compound | $R^{53}$ | Compound | $R^{53}$ |
|---|---|---|---|
| (90) | Cl | (91) | $OCH_3$ |
| (92) | 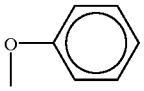 | (93) | 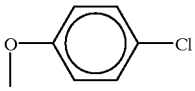 |
| (94) | 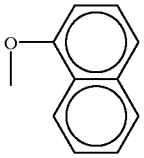 | (95) | 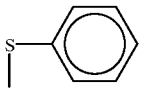 |
| (96) | 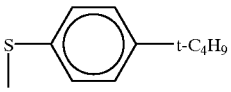 | (97) | 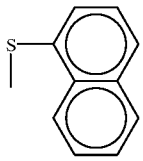 |
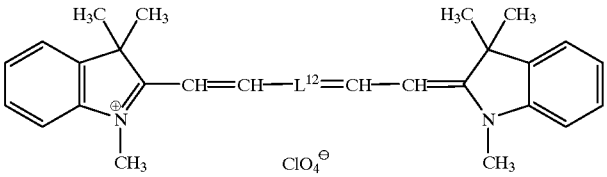
| Compound | $L^{12}$ | Compound | $L^{12}$ |
|---|---|---|---|
| (98) | 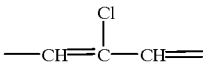 | (99) | 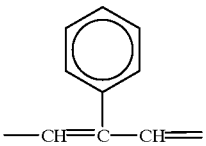 |

-continued
(100)
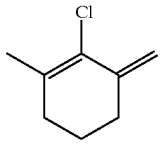
(101)
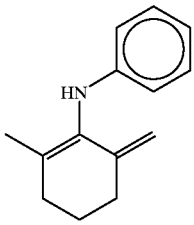
(102)
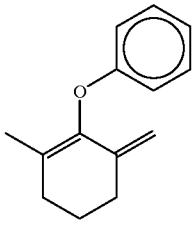
(103)
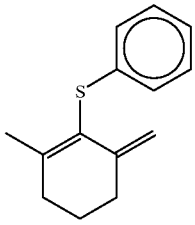
(104)
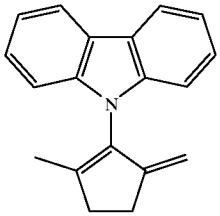
(105)
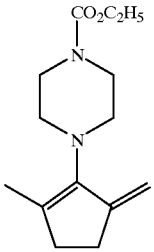
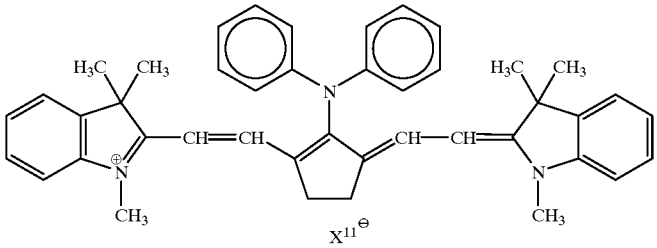
| Compound | $X^{11\ominus}$ | Compound | $X^{11\ominus}$ |
|---|---|---|---|
| (106) | $ClO_4^{\ominus}$ | (107) | $PF_6^{\ominus}$ |
| (108) | 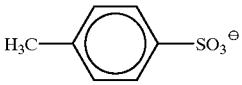 | (109) | $I^{\ominus}$ |
| (110) | $Br^{\ominus}$ | | |
| (111) | 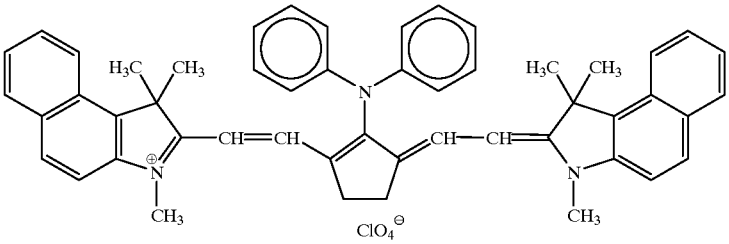 | | |

-continued
(112)
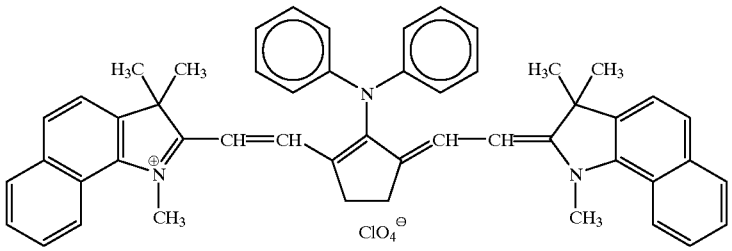
(113)
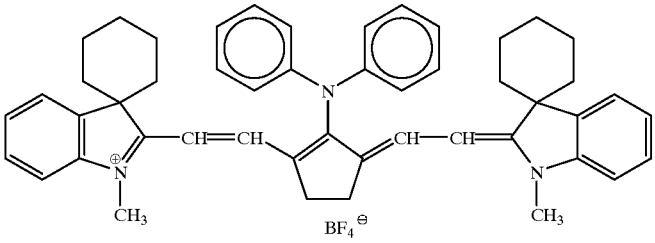
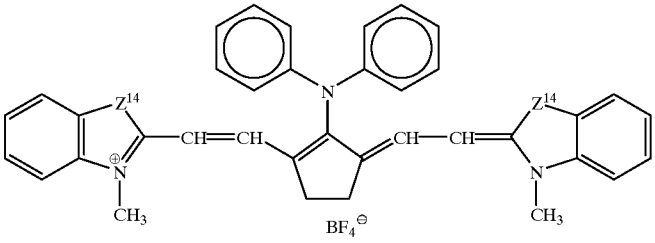
| Compound | $Z^{14}$ | Compound | $Z^{14}$ | Compound | $Z^{14}$ |
|---|---|---|---|---|---|
| (114) | O | (115) | S | (116) | 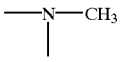 |
(117)
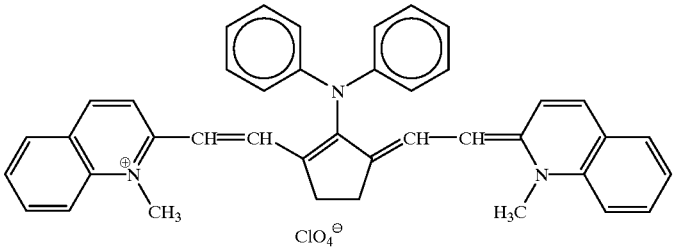
(118)
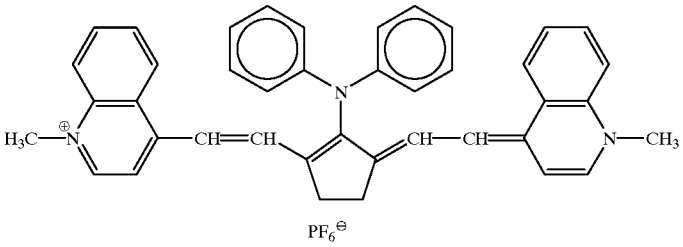

-continued
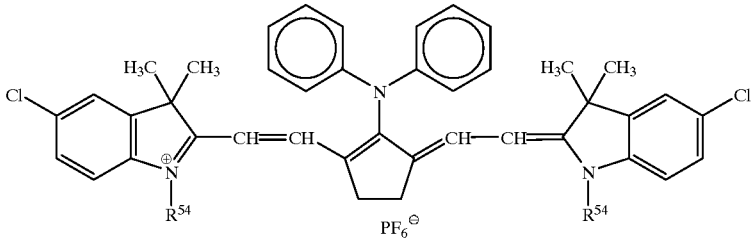
| Compound | $R^{54}$ | Compound | $R^{54}$ |
|---|---|---|---|
| (119) | 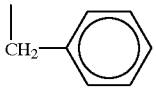 | (120) | 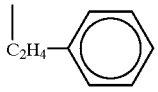 |
| (121) | 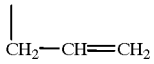 | | |
| (122) | 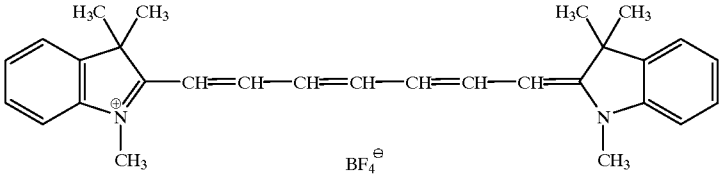 | | |
| (123) | 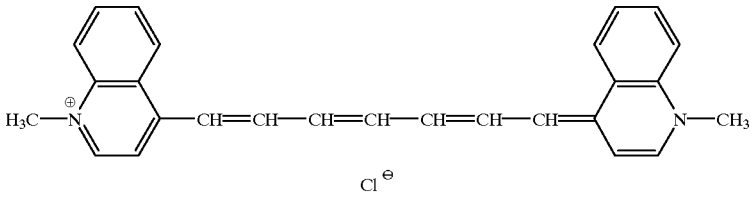 | | |
| (124) | 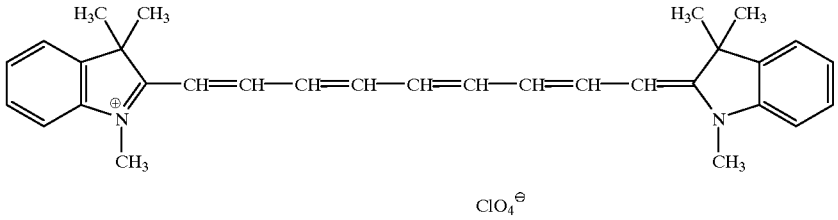 | | |
| (125) | 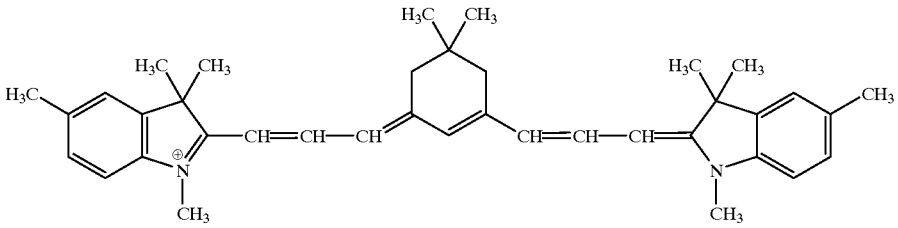 | | |

-continued

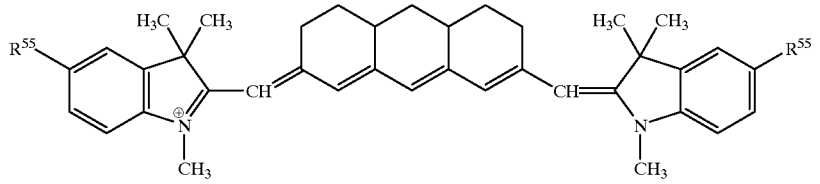

| Compound | $R^{55}$ | Compound | $R^{55}$ |
|---|---|---|---|
| (126) | H | (127) | $CO_2H$ |

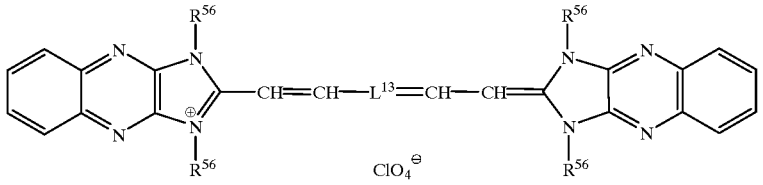

| Compound | $R^{56}$ | $L^{13}$ |
|---|---|---|
| (128) | $C_2H_4CO_2H$ | —CH═CH—CH═ |
| (129) | $C_2H_4CO_2H$ | 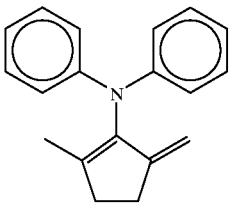 |
| (130) | $C_3H_7$ | 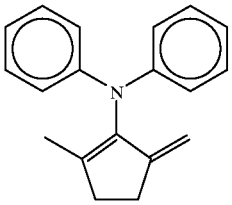 |

The above cyanine dyes can be synthesized with reference to the following Synthetic Examples. Similar synthetic methods are described in the specifications of U.S. Pat. No. 2,095,854, U.S. Pat. No. 3,671,648, JP-A-62-123252 and JP-A-6-43583.

Synthetic Example 1

Synthesis of compound (1)

9.8 g of 1,2,3,3-tetramethyl-5-carboxyindolenium p-toluenesulfonate, 6 g of 1-[2,5-bis(anilinomethylene) cyclopentylidene]-diphenylaminium tetrafluoroborate, 100 mL of ethyl alcohol, 5 mL of acetic anhydride and 10 mL of triethylamine were agitated at an external temperature of 100° C. for 1 hr, and precipitated crystal was separated by filtration. The separated crystal was recrystallized from 100 mL of methyl alcohol, thereby obtaining 7.3 g of compound (1).

melting point: 270° C. or above,

λmax: 809.1 nn, and

ϵ: $1.5\times10^5$ (dimethyl sulfoxide).

Synthetic Example 2

Synthesis of compound (43)

1.8 mL of triethylamine and 0.95 g of N-phenyl[7-phenylamino-3,5-(β,β-dimethyltrimethylene)heptatrien-2,4,6-ylidene-1]ammonium chloride were added to a mixture of 2 g of 1,2,3,3-tetramethyl-5-carboxyindolenium p-toluenesulfonate and 10 mL of methyl alcohol. Further, 2 mL of acetic anhydride was added and agitated at room temperature for 3 hr. 2 mL of water was added, and precipitated crystal was separated by filtration. Thus, 1.1 g of compound (43) was obtained.

melting point: 270° C. or above,

λmax: 855.0 nm, and

ϵ: $1.69\times10^5$ (methanol)

Synthetic Example 3

Synthesis of compound (63)

11.4 g of 1,2,3,3-tetramethyl-5-chlorindolenium p-toluenesulfonate, 7.2 g of N-(2,5-dianilinomethylenecyclopentylidene)-diphenylaluminum tetrafluoroborate, 100 mL of ethyl alcohol, 6 mL of acetic anhydride and 12 mL of triethylamine were agitated at an external temperature of 100° C. for 1 hr, and precipitated crystal was separated by filtration. The separated crystal was recrystallized from 100 mL of methyl alcohol, thereby obtaining 7.3 g of compound (63).

melting point: 250° C. or above,

λmax: 800.8 nm, and

ε: $2.14\times10^5$ (chloroform).

This cyanine dye may be formed into a lake to thereby use it as a lake cyanine dye. Preferred lake cyanine dye is represented by the following formula (II).

$$(D)\text{-}A_m\cdot Y_n \qquad (II)$$

In the formula (II), D represents the skeleton of cyanine dye represented by the following formula (Ia).

(Ia)

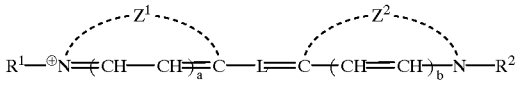

In the formula (Ia), $Z^1$ and $Z^2$ each independently represent nonmetallic atom groups forming five-membered or six-membered nitrogen-containing heterocycles which may undergo ring condensation together with $^+N{=}(CH{-}CH)_a{=}C$ and $C{-}(CH{=}CH)_b{-}N$, respectively. Each of $R^1$ and $R^2$ independently represents an alkyl group, an alkenyl group or an aralkyl group. L represents a connecting group in which 5, 7 or 9 methine groups are bonded with each other so that the double bonds conjugate with each other. Each of a and b is independently 0 or 1.

The number of carbon atoms, examples, possible substituents, preferred groups and more preferred groups of $Z^1$, $Z^2$, $R^1$, $R^2$ and L of the formula (Ia) and preferred values of a and b of the formula (Ia) are the same as those mentioned above with regard to $Z^1$, $Z^2$, $R^1$, $R^2$, L, a and b of the formula (I), respectively.

In the formula (II), A represents an anionic dissociation group bonded with D as a substituent. Examples of the anionic dissociation groups include carboxyl, sulfo, phenolic hydroxyl, a sulfonamide, sulfamoyl and phosphono. Carboxyl, sulfo and sulfonamide are preferred. Carboxyl is more preferred.

In the formula (II), Y represents a cation which converts a cyanine dye to a lake. Examples of the inorganic cations include alkaline earth metal ions (e.g., $Mg^{2+}$, $Ca^{2+}$, $Ba^{2+}$ and $Sr^{2+}$), transition metal ions (e.g., $Ag^+$ and $Zn^{2+}$) and other metal ions (e.g., $Al^{3+}$). Examples of the organic cations include ammonium ion, amidinium ion and guanidinium ion. Organic cations preferably have 4 or more carbon atoms. Divalent or trivalent cations are preferred.

In the formula (II), m is an integer of 2 to 5. m is preferably 2, 3 or 4.

In the formula (II), n is an integer of 1 to 5 required for a charge balance. n is generally 1, 2 or 3.

The lake cyanine dye may be in the form of a double salt.

Examples of preferred lake cyanine dyes are set forth below:

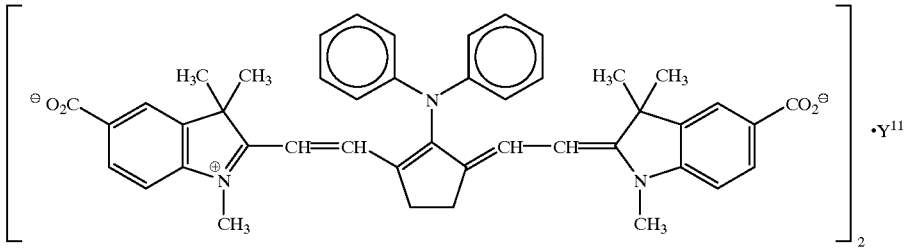

| Compound | $Y^{11}$ | Compound | $Y^{11}$ | Compound | $Y^{11}$ |
|---|---|---|---|---|---|
| (131) | $Ca^{2\oplus}$ | (132) | $Ba^{2\oplus}$ | (133) | $Mg^{2\oplus}$ |
| (134) | $Sr^{2\oplus}$ | (135) | $Zn^{2\oplus}$ | | |

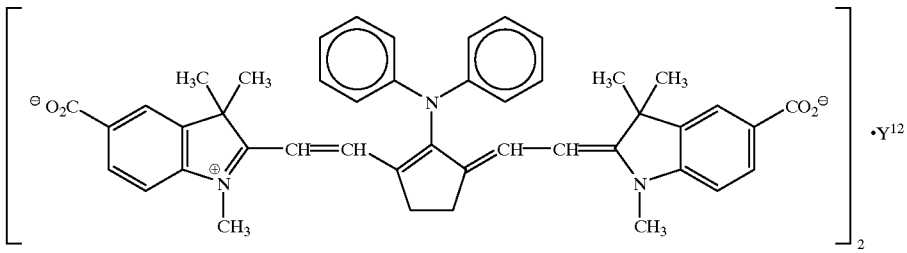

| Compound | $Y^{12}$ |
|---|---|
| (136) | 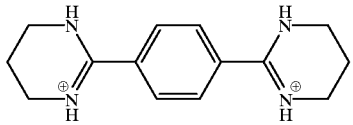 |

-continued
(137)
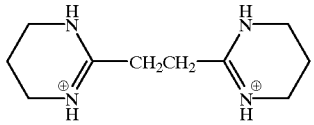
(138)
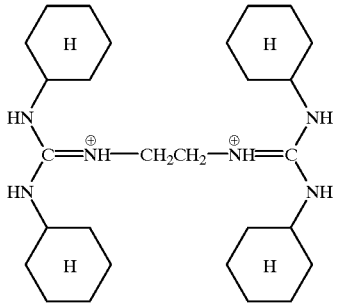
(139)
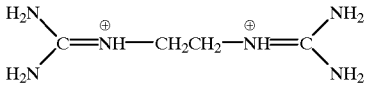
(140)
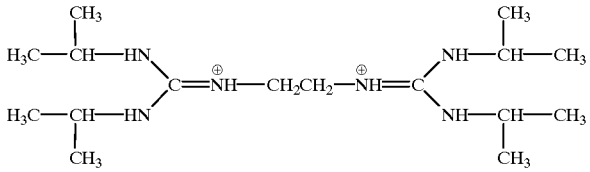
(141)
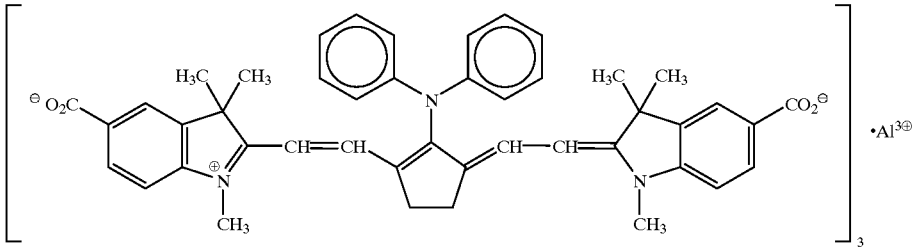
(142)
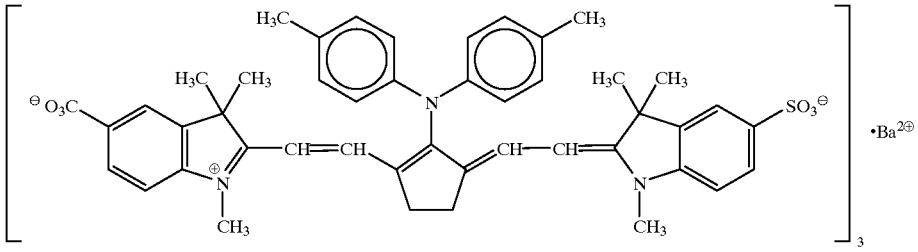
(143)
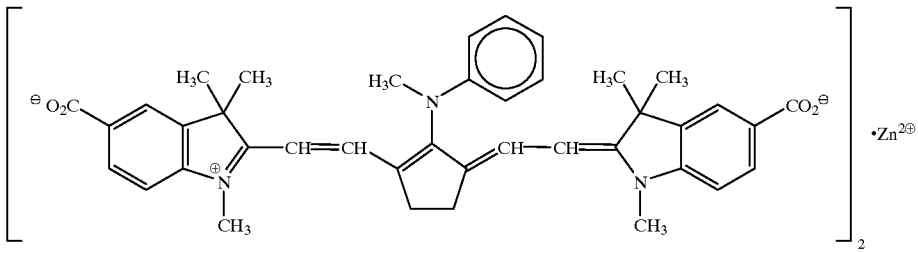

-continued
(144)
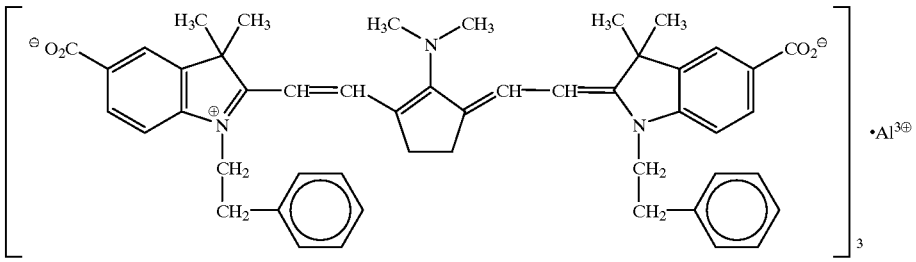
(145)
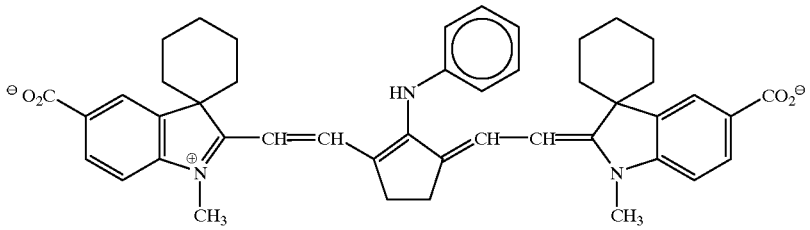
(146)
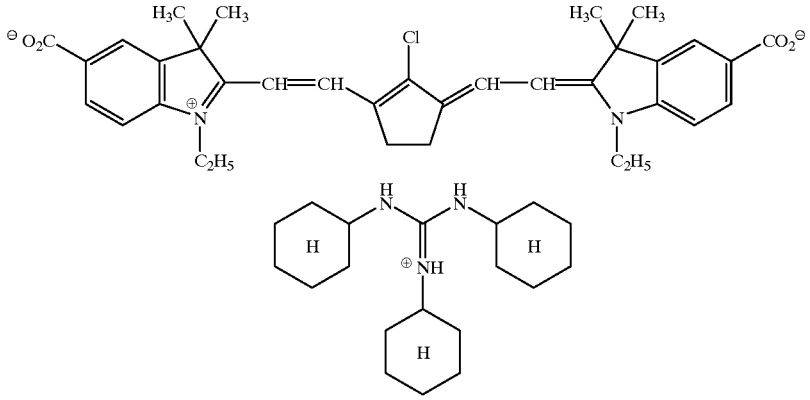
(147)
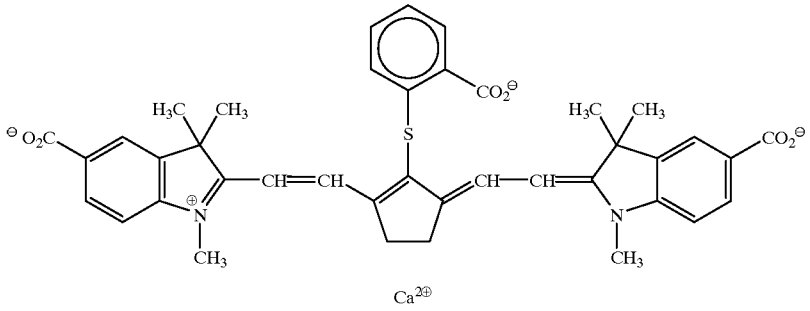
(148)
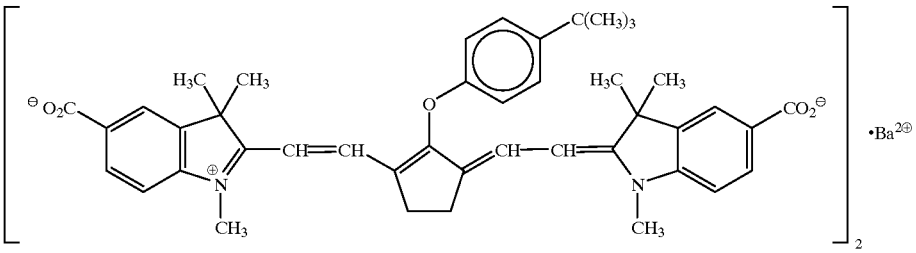

-continued
(149)
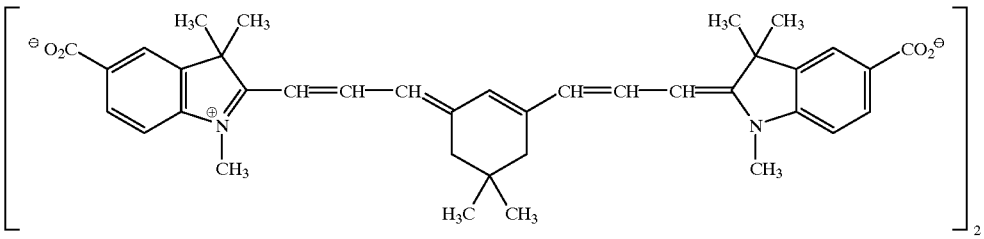
$Ca^{2\oplus}$
(150)
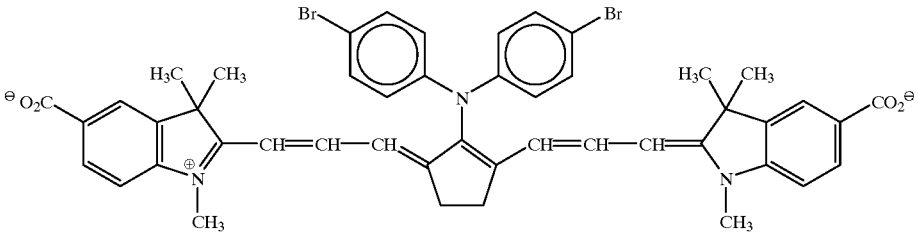
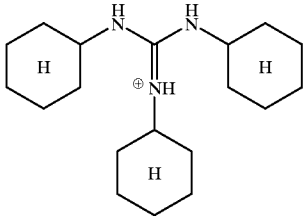
(151)
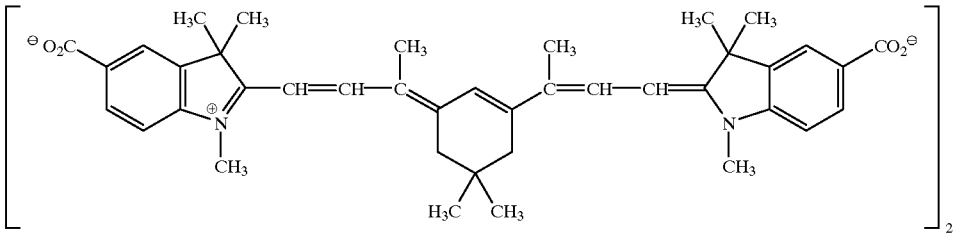
$Zn^{2\oplus}$
(152)
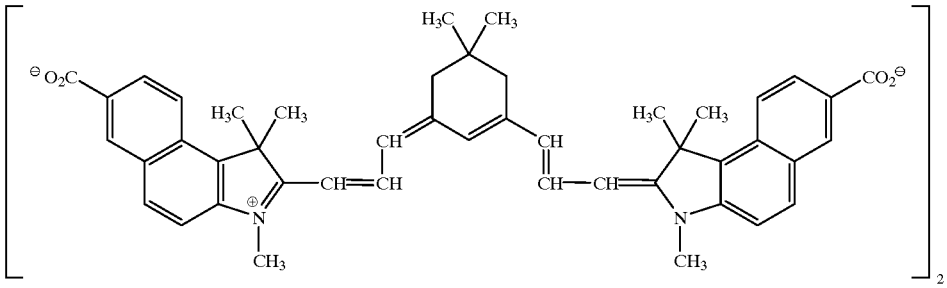
$Ba^{2\oplus}$ -continued
(153)
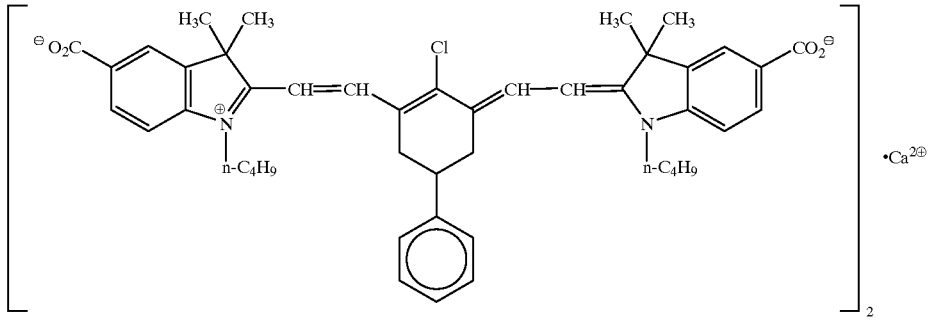
(154)
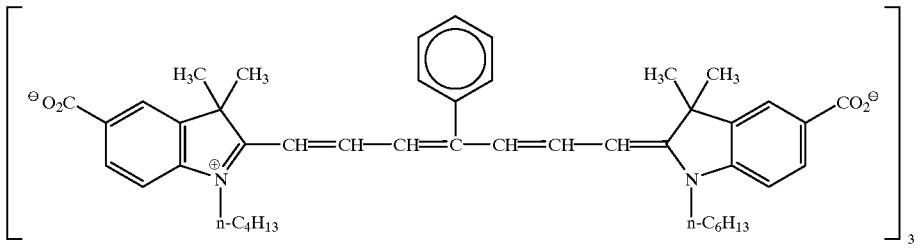
$Al^{3\oplus}$
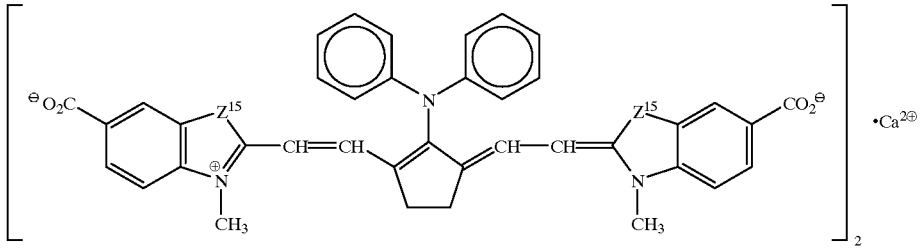
| Compound | $Z^{15}$ | Compound | $Z^{15}$ | Compound | $Z^{15}$ |
|---|---|---|---|---|---|
| (155) | O | (156) | S | (157) | 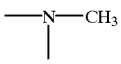 |
(158)
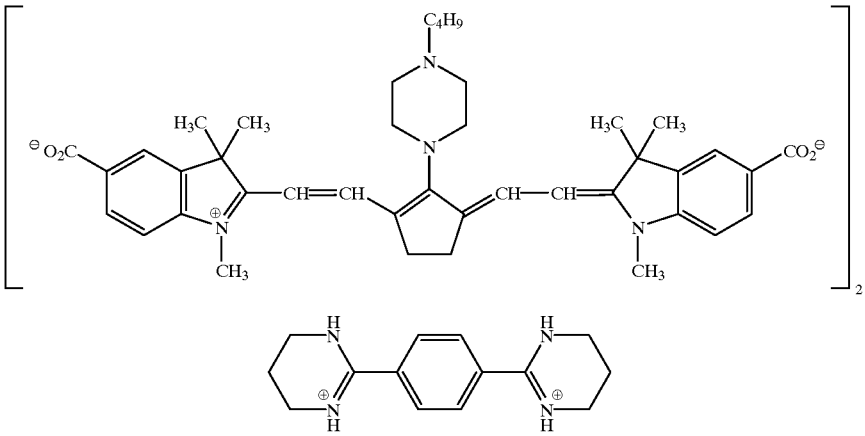

-continued
(159)
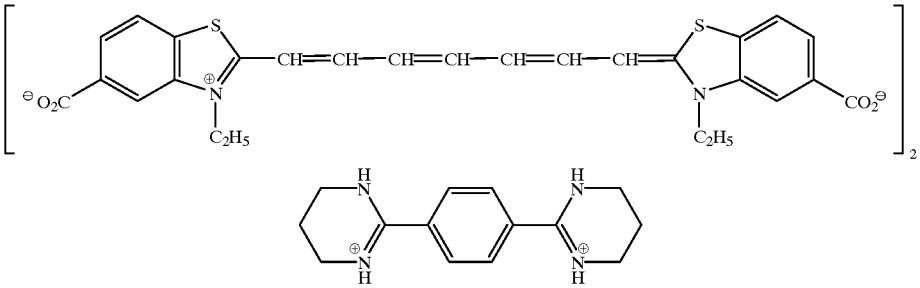
(160)
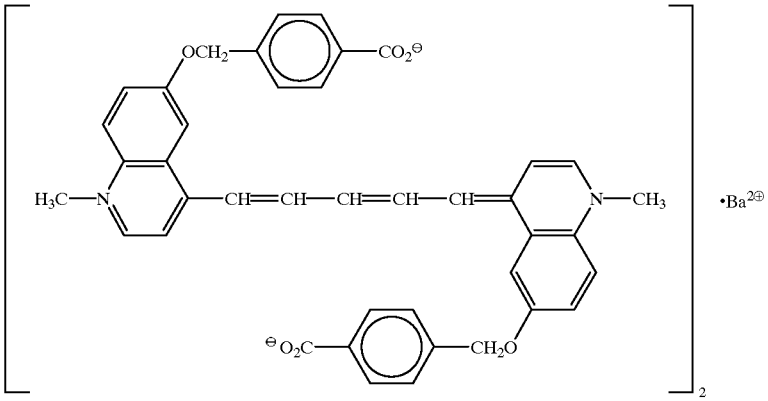
(161)
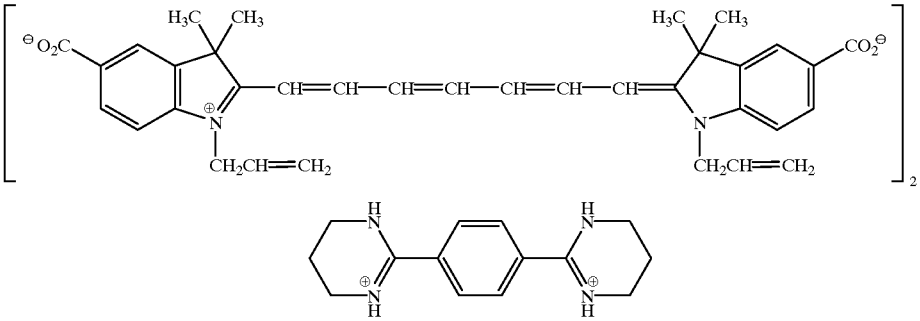
(162)
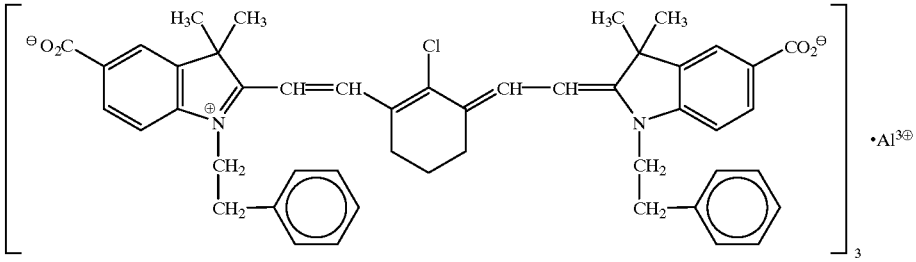

-continued
(163)
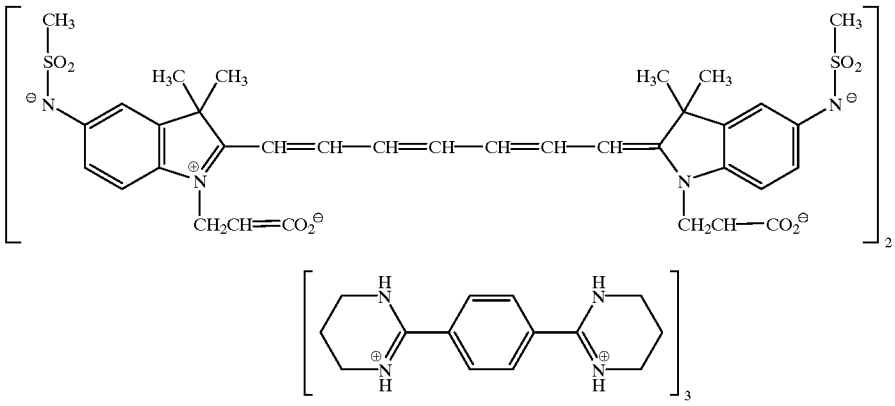
(164)
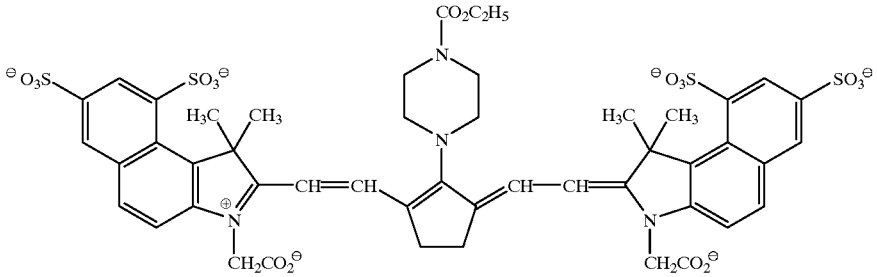
$(Ag^{\oplus})_5$
(165)
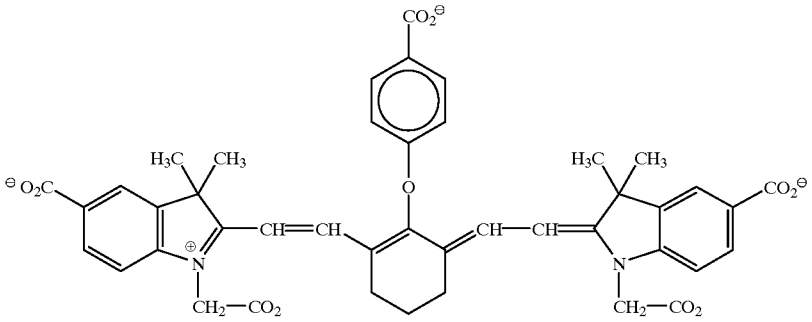
$(Zn^{2\oplus})_2$ -continued (166)

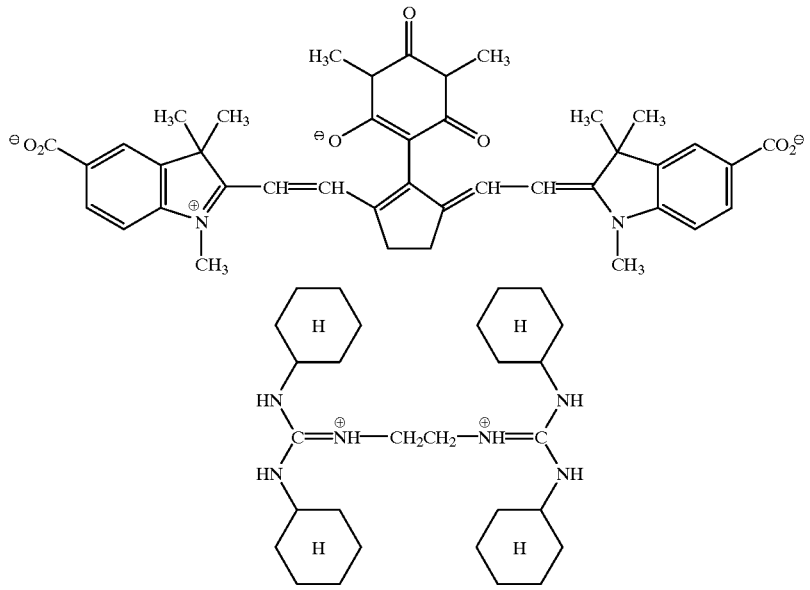

(167)

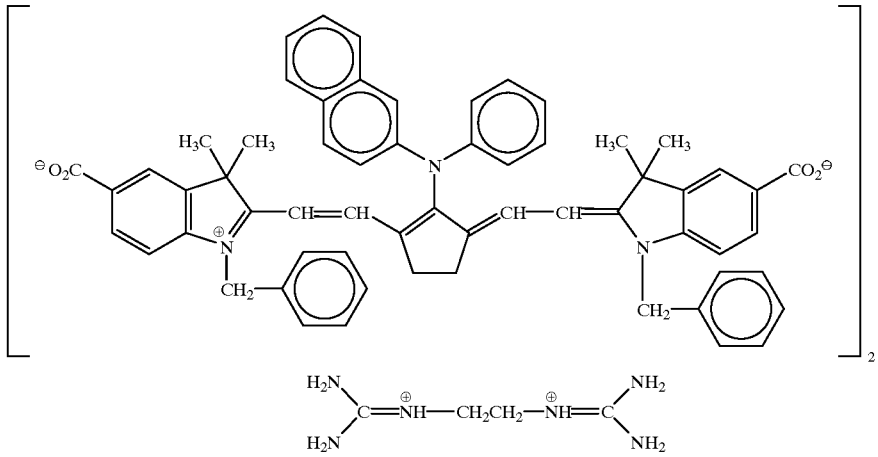

The above lake cyanine dyes can be synthesized with reference to the following Synthetic Examples.

Synthetic Example 4

Synthesis of compound (131)

20 mL of an aqueous solution containing 2 g of calcium chloride was added to a solution consisting of 4 g of the crystal of the compound (1) synthesized in Synthetic Example 1, 50 mL of water and 2.6 mL of triethylamine and agitated for 1 hr. Precipitate was separated by filtration, thereby obtaining 11.5 g of a wet cake of compound (131). The dry weight was 3.4 g.

Synthetic Example 5

Synthesis of compound (132)

10.6 g of a wet cake of compound (132) was obtained in the same manner as in Synthetic Example 4, except that barium chloride was used in place of calcium chloride. The dry weight was 3.4 g.

Synthetic Example 6

Synthesis of compound (141)

12.0 g of a wet cake of compound (141) was obtained in the same manner as in Synthetic Example 4, except that $Al_{13}O_4(OH)_{24}(H_2O)_{12}Cl_7$ (aluminum hydrochloride-P, produced by Hoechst) was used in place of calcium chloride. The dry weight was 1.7 g.

Synthetic Example 7

Synthesis of compound (138)

A solution prepared by dissolving 3.3 g of the following guanidine compound in 20 mL of methanol was added to a solution consisting of 4 g of the crystal of the compound (1) synthesized in Synthetic Example 1, 30 mL of methanol and 1.7 mL of triethylamine and agitated at room temperature for 3 hr. Precipitate was separated by filtration, thereby obtaining 3.9 g of a wet cake of compound (138). The dry weight was 2.1 g.

(Guanidine compound)

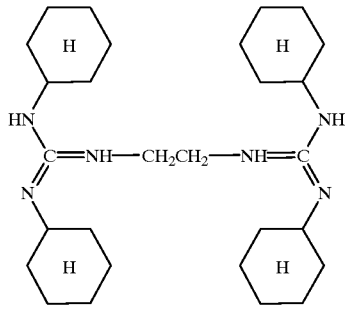

In the present invention, the infrared absorbing dye can be used in the form of solid fine grains. Known dispersers can be used for forming the infrared absorbing dye into solid fine grains. Examples of the dispersers include a ball mill, a vibrating ball mill, a planetary ball mill, a sand mill, a colloid mill, a jet mill and a roller mill. Dispersers are described in the specifications of JP-A-52-92716 and PCT International Publication 88/074794. Vertical or horizontal medium dispersers are preferred.

The dispersion may be carried out in the presence of an appropriate medium (e.g., water or an alcohol). Dispersion surfactants are preferably employed. Anionic surfactants (described in the specifications of JP-A-52-92716 and PCT International Publication 88/074794) are preferably used as the dispersion surfactants. If necessary, an anionic polymer, a nonionic surfactant or a cationic surfactant may be used.

Fine grain powder may be obtained by dissolving the infrared absorbing dye in an appropriate solvent and thereafter adding a poor solvent thereto. In this method as well, the above dispersion surfactant may be used. Alternatively, microcrystals of the dye may be obtained by adjusting a pH thereby effect a dissolution and thereafter changing the pH.

When the lake dye is employed, microcrystals of the lake dye may be precipitated by dissolving the dye corresponding to (D)-$A_m$ of the above formula (II) at an appropriate pH value and thereafter adding a water soluble salt of a cation corresponding to Y of the above formula (II).

The average grain size of the solid fine grains is preferably 0.005 to 10 $\mu$m, more preferably 0.01 to 1 $\mu$m, still more preferably 0.01 to 0.5 $\mu$m and most preferably 0.01 to 0.11 $\mu$m.

The infrared absorbing dye is contained in the solid fine grains in an amount of preferably 80% by weight or more, more preferably 90% by weight or more and most preferably 100% by weight or more.

Although the solid fine grains of the infrared absorbing dye may be added in an amount such that the transmission density at 950 nm is at least 1.7 in cooperation with other infrared absorbing substance (e.g., colloidal silver and a silver halide) of the light-sensitive material, the coating amount thereof per $m^2$ of the light-sensitive material ranges preferably from 0.001 to 1 g/$m^2$ and more preferably from 0.005 to 0.5 g/$m^2$. This coating amount of the infrared absorbing dye applies also when the infrared absorbing dye is added in the form of the following oil composition or polymer composition.

Infrared absorbing dyes represented by the general formulae (1), (2) and (3) preferably employed in the present invention will be described below.

The general formula (1) will now be described in detail.

General formula (1)

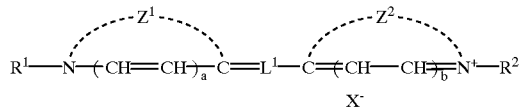

In the formula, $Z^1$ and $Z^2$ each represent nonmetallic atom groups required to form a five-membered or six-membered nitrogen-containing heterocycles which may undergo ring condensation together with $N(—CH=CH)_a—C$ and $C(=CH—CH)_b=N^+$, respectively. Each of $R^1$ and $R^2$ represents an alkyl group, an alkenyl group or an aralkyl group. $L^1$ represents a connecting group resulting from linking of 7, 9 or 11 methine groups through conjugated double bonds. Each of a and b is 0 or 1. X represents an anion.

Examples of the five-membered or six-membered nitrogen-containing heterocycles formed with $Z^1$ or $Z^2$ which may undergo ring condensation include an oxazole ring, an isoxazole ring, a benzoxazole ring, a naphthoxazole ring, a thiazole ring, a benzothiazole ring, a naphthothiazole ring, an indolenine ring, a benzindolenine ring, an imidazole ring, a benzimidazole ring, a naphthimidazole ring, a quinoline ring, a pyridine ring, a pyrrolopyridine ring, a furopyrrole ring, an imidazoquinoline ring and an imidazoquinoxaline ring. Five-membered nitrogen-containing heterocycles fused with a benzene or naphthalene ring are preferred, and indolenine and quinoline rings are most preferred. These rings may be substituted. Examples of the substituents include lower alkyl groups having 1 to 6 carbon atoms (e.g., methyl and ethyl), alkoxy groups (e.g., methoxy and ethoxy), phenoxy groups (e.g., unsubstituted phenoxy and p-chlorophenoxy), halogen atoms (Cl, Br and F), alkoxycarbonyl groups (e.g., ethoxycarbonyl), cyano and nitro.

The alkyl group represented by $R^1$ or $R^2$ is one having 1 to 20 carbon atoms, preferably, 1 to 12 carbon atoms (e.g., methyl, ethyl, propyl, butyl, isobutyl, pentyl, hexyl and octyl). The alkyl group may be substituted with, for example, a halogen atom (F, Cl or Br), an alkoxycarbonyl group (e.g., methoxycarbonyl or ethoxycarbonyl) or a hydroxy group.

The aralkyl group represented by $R^1$ or $R^2$ is preferably one having 7 to 12 carbon atoms (e.g., benzyl or phenethyl) and may have one or more substituents (e.g., methyl, an alkoxy or a chlorine atom).

The alkenyl group represented by $R^1$ or $R^2$ is preferably one having 2 to 10 carbon atoms, examples of which include 2-pentenyl, vinyl, allyl, 2-butenyl and 1-propenyl groups.

$L^1$ represents a connecting group resulting from linking of 7, 9 or 11 methine groups through conjugated double bonds, in which 3 methine groups may be bonded with each other to thereby form a cyclopentene ring or a cyclohexene ring.

Examples of anions represented by X include halide ions (Cl, Br and I), p-toluenesulfonate ion, ethyl sulfate ion, $PF_6^-$, $BF_4^-$ and $ClO_4^-$.

The general formula (2) will now be described in detail.

General formula (2)

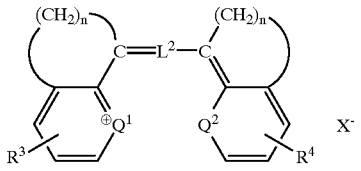

In the formula, each of $Q^1$ and $Q^2$ represents an oxygen atom or a sulfur atom. Each of $R^3$ and $R^4$ represents a hydrogen atom, an alkyl group or an aryl group. $L^2$ represents a connecting group resulting from linking of 3 or 5 methine groups through conjugated double bonds. n is 2 or 3. X represents an anion.

The alkyl group represented by $R^3$ or $R^4$ is one having preferably 1 to 20 carbon atoms and more preferably 1 to 12 carbon atoms (e.g., methyl, ethyl, t-butyl, octyl and dodecyl). The alkyl group may be substituted with, for example, a halogen atom (F, Cl or Br) or a hydroxy group. The aryl group represented by $R^3$ or $R^4$ is preferably a phenyl group which may be substituted with, for example, a methyl group, a methoxy group or a halogen atom (F, Cl or Br). The anion represented by X has the same meaning as that of X of the above general formula (1).

The general formula (3) will now be described in detail.

General formula (3)

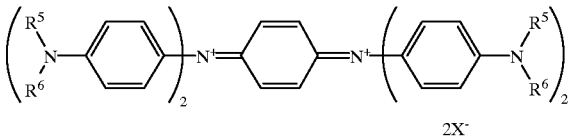

In the formula, each of $R^5$ and $R^6$ represents an alkyl group. X represents an anion.

The alkyl group represented by $R^5$ or $R^6$ is one having preferably 1 to 20 carbon atoms and more preferably 1 to 12 carbon atoms (e.g., methyl, ethyl, butyl, hexyl, octyl and dodecyl). The anion represented by X has the same meaning as that of X of the above general formula (1).

Some examples of the present invention will be listed below, which in no way limit the scope of the present invention.

A1

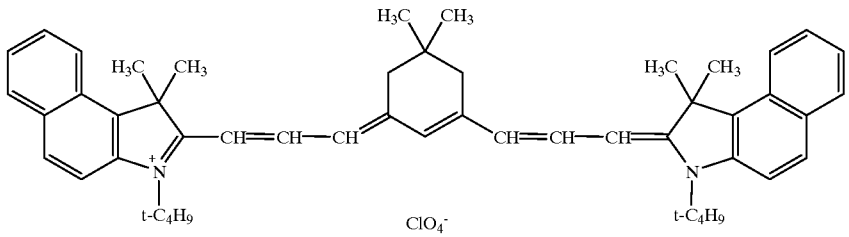

A2

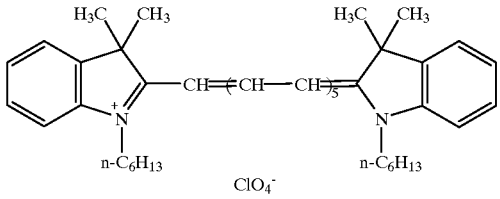

A3

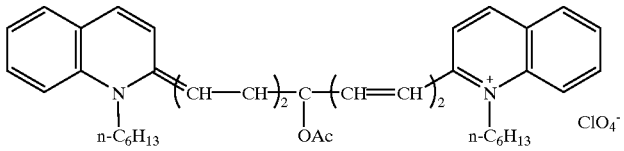

Ac: Acetyl group

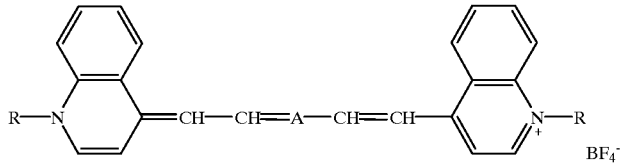

| Compound | R | A |
|---|---|---|
| A4 | n-$C_4H_9$ | =CH—CH=CH— |
| A5 | n-$C_8H_{17}$ | =CH—CH=CH— |

-continued

| | | |
|---|---|---|
| A6 | $n\text{-}C_8H_{17}$ | 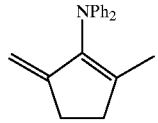 |

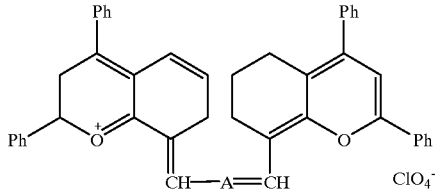

| Compound | A |
|---|---|
| A7 | —CH= |
| A8 | —CH=CH—CH= |

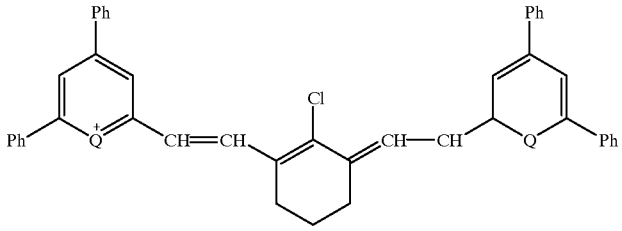

Ph: phenyl group

| Compound | Q |
|---|---|
| A9 | O |
| A10 | S |

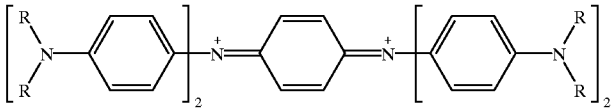

| Compound | R |
|---|---|
| A11 | $n\text{-}C_2H_5$ |
| A12 | $n\text{-}C_4H_9$ |
| A13 | $n\text{-}C_6H_{13}$ |

The infrared absorbing dyes of the general formula (1) according to the present invention can be synthesized with reference to JP-A-46-14830, JP-A-52-110727 and JP-A-62-123454. The infrared absorbing dyes of the general formula (2) can be synthesized with reference to U.S. Pat. No. 3,417,083. The infrared absorbing dyes of the general formula (3) can be synthesized with reference to Japanese Patent Application KOKOKU Publication No. (hereinafter referred to as JP-B-) 43-25335.

The following methods (1) to (4) can be mentioned as those in which the infrared absorbing dye for use in the present invention is applied in the form of an oil composition or a polymer composition. Of these methods, the method (1) is preferred to the others.

Method (1):

This method comprises dissolving the infrared absorbing dye compound in an oil, i.e., a substantially water insoluble high boiling point solvent whose boiling point is approximately 160° C. or above, adding the solution to a hydrophilic colloid solution and effecting a dispersion. In this method, use can be made of any of high boiling point solvents described in U.S. Pat. No. 2,322,027 such as alkyl phthalates (e.g., dibutyl phthalate and dioctyl phthalate), phosphoric esters (e.g., diphenyl phosphate, triphenyl phosphate, tricresyl phosphate and dioctyl butyl phosphate), citric esters (e.g., tributyl acetylcitrate), benzoic esters (e.g., octyl benzoate), alkylamides (e.g., diethyllaurylamide), fatty acid esters (e.g., dibutoxyethyl succinate and diethyl azelate) and trimesic esters (e.g., tributyl trimesate). Further, use can be made of any of organic solvents having a boiling point of approximately 30° C. to approximately 150° C., for example, lower alkyl acetates such as ethyl acetate and butyl acetate, ethyl propionate, sec-butyl alcohol, methyl isobutyl ketone, a-ethoxyethyl acetate, methyl cellosolve acetate and readily water soluble solvents, e.g., alcohols such as methanol and ethanol.

The infrared absorbing dye and the high boiling point solvent are preferably used in a weight ratio of 10/1 to 1/10. That is, the amount of high boiling point solvent is 0.1 to 10 times as much as that of the infrared absorbing dye, in terms of weight.

Method (2):

This method is the same as the above method (1) except that a polymer, specifically, a water insoluble but organic solvent soluble polymer is used in place of the high boiling point solvent or in combination with the high boiling point solvent. The infrared absorbing dye and the polymer employed in place of the high boiling point solvent of the method (1) are preferably used, and also the infrared absorbing dye and the high boiling point solvent plus polymer employed in combination with the high boiling point solvent are preferably used in a weight ratio of 10/1 to 1/10.

This method is described in, for example, JP-A-5-45794, JP-A-5-45789 and JP-A-5-158190.

Method (3):

This method comprises incorporating the infrared absorbing dye for use in the present invention and other additives in a photographic emulsion layer or other hydrophilic colloid layer polymer latex composition.

The above polymer latex is, for example, a polyurethane polymer or any of polymers obtained by polymerizing vinyl monomers {Examples of the vinyl monomers include acrylic esters (e.g., methyl acrylate, ethyl acrylate, butyl acrylate, hexyl acrylate, octyl acrylate, dodecyl acrylate and glycidyl acrylate), α-substituted acrylic esters (e.g., methyl methacrylate, butyl methacrylate, octyl methacrylate and glycidyl methacrylate), acrylamides (e.g., butylacrylamide and hexylacrylamide),a-substituted acrylamides (e.g., butylmethacrylamide and dibutylmethacrylamide), vinyl esters (e.g., vinyl acetate and vinyl butyrate), halogenated vinyls (e.g., vinyl chloride), halogenated vinylidenes (e.g., vinylidene chloride), vinyl ethers (e.g., vinyl methyl ether and vinyl octyl ether), styrene, X-substituted styrenes (e.g., α-methylstyrene), nucleus-substituted styrenes (e.g., hydroxystyrene, chlorostyrene and methylstyrene), ethylene, propylene, butylene, butadiene and acrylonitrile. These may be used either individually or in combination and may be used in the form of a mixture with another vinyl monomer as a minor component. Examples of the other vinyl monomers include itaconic acid, acrylic acid, methacrylic acid, hydroxyalkyl acrylates, hydroxyalkyl methacrylates, sulfoalkyl acrylates, sulfoalkyl methacrylates and styrylsulfonic acid.}.

These packing polymer latexes can be produced in accordance with the processes described in JP-B-51-39853, JP-A-51-59943, JP-A-53-137131, JP-A-54-32552, JP-A-54-107941, JP-A-55-133465, JP-A-56-19043, JP-A-56-19047, JP-A-56-126830 and JP-A-58-149038.

The infrared absorbing dye compound and the polymer latex are preferably used in a weight ratio of 10/1 to 1/10.

Method (4):

This method is the same as the above method (1) except that a hydrophilic polymer is used in place of the high boiling point solvent or in combination with the high boiling point solvent. This method is described in, for example, U.S. Pat. Nos. 3,619,195 and DE 1,957,467. The infrared absorbing dye and the hydrophilic polymer employed in place of the high boiling point solvent of the method (1) are preferably used, and also the infrared absorbing dye and the high boiling point solvent plus hydrophilic polymer employed in combination with the high boiling point solvent are preferably used in a weight ratio of 10/1 to 1/10.

The infrared absorbing dye for use in the present invention is preferably one which is not leached during the development and whose absorption spectrum configuration and maximum absorption wavelength substantially do not change between before the development and after the development.

The infrared absorbing dye for use in the present invention, added in the form of the oil composition or polymer composition, has $\lambda_{max}$ in light-sensitive material of 700 to 1400 nm, preferably 750 to 900 nm in an infrared sensitive material using a semiconductor laser in an exposure device and 900 to 1000 nm when used for a position detection in a light-sensitive material photographing device or automatic developing machine, so that the absorption of visible region (400 to 700 nm) is slight or, if any, not detrimental to the photographic properties.

In the present invention, although the dye having an absorption maximum wavelength in the infrared region of 700 to 1100 nm may be added to at least one of the photosensitive emulsion layers and nonphotosensitive hydrophilic colloid layers even if it is in the form of solid fine grains (hereinafter referred to as "solid fine grain forming infrared absorbing dye") or in the form of an oil drop dispersion (hereinafter referred to as "oil drop dispersion forming infrared absorbing dye"), it is preferred that the infrared absorbing dye be added to nonphotosensitive hydrophilic colloid layers such as an antihalation layer, an interlayer, a yellow filter layer and a protective layer. More preferably, the addition is effected to the antihalation layer. The dye can be added to the back layer of the light-sensitive meterial, i.e., the layer coated on the side of the support opposit to the photosensitive emulsion layer.

Although the coating amount of the infrared absorbing dye is not particularly limited, it is requisite that the infrared absorbing dye together with other infrared absorbing substances employed in the light-sensitive material (e.g., colloidal silver (black and yellow ones) and silver halides) realize a transmission density at 950 nm of at least 1.7.

The transmission density is more preferably at least 1.8 and most preferably at least 1.9.

The ratio, defining the transmission density at 950 nm, of the infrared absorbing dye to the other infrared absorbing substances employed in the light-sensitive material (e.g., colloidal silver and silver halides) is preferably determined taking the photographic performance into consideration.

For example, when the proportion of the infrared absorbing dye is decreased with the proportion of black colloidal silver increased, the above photographing of a date and time by an exposure from the back side becomes difficult.

In the light-sensitive material of the present invention, it is required that at least one red-sensitive silver halide emulsion layer, at least one green-sensitive silver halide emulsion layer, at least one blue-sensitive silver halide emulsion layer and at least one nonlight-sensitive hydrophilic colloidal layer containing balck colloidal silver be formed on a support. A typical example is a silver halide photographic light-sensitive material having, on its support, at least three light-sensitive layers each of which are constituted by a plurality of silver halide emulsion layers which are sensitive to essentially the same color but have different sensitivities. The three light-sensitive layers include a unit light-sensitive layer which is sensitive to one of blue light, green light and red light. In a multilayered silver halide color photographic light-sensitive material, these unit light-sensitive layers are generally arranged in the order of red-, green- and blue-sensitive layers from a support. However, according to the intended use, this arrangement order may be reversed, or light-sensitive layers sensitive to the same color can sandwich another light-sensitive layer sensitive to a different color.

Nonlight-sensitive layers can be formed between the silver halide light-sensitive layers, i.e. as an inter layer or a yellow filter layer, and as the uppermost layer, i.e., as a protective layer and the lowermost layer among the light-sensitive and non light-sensitive layers, i.e., as an antihalation layer. The nonlight-sensitive hydrophilic colloid layer containing black colloidal silver is preferably disposed nearer to the support than a light-sensitive silver halide emulsion layer arranged most close to the support.

These may contain, e.g., one ore more coupler, one or more DIR compounds and one ore more color mixing inhibitors described later.

As a plurality of silver halide emulsion layers constituting each unit light-sensitive layer, a two-layered structure of high- and low-speed emulsion layers can be preferably used such that the sensitivity is sequentially decreased toward a support as described in U.S. Pat. No. DE 1,121,470 or GB 923,045. Also, as described in JP-A-57-112751, JP-A-62-200350, JP-A-62-206541 and JP-A-62-206543, layers can be arranged such that a low-speed emulsion layer is formed apart from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adoped.

Furthermore, the arrangement can be changed as described above even when four or more layers are formed.

In order to improve the color reproducibility, a donor layer (CL) with an interlayer effect, which is described in U.S. Pat. No. 4,663,271, U.S. Pat. No. 4,705,744, U.S. Pat. No. 4,707,436, JP-A-62-160448 and JP-A-63-89850 and different from the main light-sensitive layers BL, GL and RL in spectral sensitivity distribution, is preferably formed adjacent to or close to the main light-sensitive layers.

A preferable silver halide used in the present invention is silver iodobromide, silver iodochloride or silver iodochlorobromide containing about 30 mol % or less of silver iodide. A particularly preferable silver halide is silver iodobromide or silver iodochlorobromide containing about 2 mol % to about 10 mol % of silver iodide. Most preferable silver halide is silver iodobromide containing about 2 mol % to about 10 mol % of silver iodide.

Silver halide grains contained in the photographic emulsion may have regular crystals such as cubic, octahedral or tetradecahedral crystals, irregular crystals such as spherical or tabular crystals, crystals having crystal defects such as twinned crystal faces or composite shapes thereof.

The silver halide can consist of fine grains having a grain size (diameter) of about 0.2 gm or less or large grains having a diameter of a projected area of up to about 10 gm, and the emulsion may be either a polydisperse or monodisperse emulsion.

The silver halide photographic emulsion which can be used in the present invention can be prepared by methods described in, e.g., "I. Emulsion preparation and types," Research Disclosure (to be abbreviated as RD hereafter) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. No. 3,574,628 and U.S. 3,655,394 and GB 1,413,748 are also preferable.

Also, tabular grains having an aspect ratio of about 3 or more can be used in the present invention. Tabular grains can be easily prepared by methods described in, e.g., Gutoff, "Photographic Science and Engineering", Vol. 14, pp. 248 to 257 (1970); U.S. Pat. No. 4,434,226, U.S. Pat. No. 4,414,310, U.S. Pat. No. 4,433,048, U.S. Pat. No. U.S. Pat. No. 4,439,520, and GB 2,112,157.

The crystal structure can be uniform, can have halogen compositions which are different between the inner portion and the outer portion thereof, or can be a layered structure. Alternatively, the silver halide having a different composition can be bonded by an epitaxial junction, a compound other than a silver halide such as silver rhodanide or lead oxide can also be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and an emulsion of another type which has latent images on the surface and in the interior of a grain. However, the emulsion must be a negative type emulsion. In this case, the internal latent image type emulsion can be a core/shell internal latent image type emulsion described in JP-A-63-264740. The method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

The silver halide emulsion is generally subjected to physical ripening, chemical ripening and spectral sensitization before use. Additives used in these steps are listed in RD No. 17643, RD No. 18716 and RD No. 307105, relevant portions of which are summarized in a below given table.

In the light-sensitive material of the present invention, at least two light-sensitive silver halide emulsions which are different from each other in at least one property among emulsion grain size, grain size distribution, halogen composition, grain shape and sensitivity can be mixed together and used in a single layer.

Colloidal silver, silver halide grains having their inner part fogged as described in U.S. Pat. No. 4,626,498 and JP-A-59-214852 and silver halide grains having their surface fogged as described in U.S. Pat. No. 4,082,553 are preferably used in the light-sensitive silver halide emulsion layer and/or substantially nonlight-sensitive hydrophilic colloid layer. The silver halide grains having their inner part or surface fogged refers to the silver halide grains which can be developed uniformly (in nonimagewise manner), irrespective of the exposed or unexposed part of the light-sensitive material. The process for producing the same is described in U.S. Pat. No. 4,626,498 and JP-A-59-214852. Silver halides forming internal nuclei of core/shell type silver halide grains having their internal part fogged may have different halogen compositions between the core and the shell. The silver halide having its grain inner part or surface fogged can be any of silver chloride, silver chlorobromide, silver iodobromide and silver chloroiodobromide. The average grain size of these fogged silver halide grains is preferably in the range of 0.01 to 0.75 $\mu$m, more preferably, 0.05 to 0.6 $\mu$m. Grain shape may be regular or irregular. Dispersion property of the emulsion may be polydispersed or monodispersed. However, monodispersion (at least 95% of the total weight or whole number of grains of the silver halide grains have a grain size which is within ±40% of the average grain size) is preferred.

In the present invention, it is preferable to use a nonlight-sensitive fine grain silver halide. The nonlight-sensitive fine grain silver halide preferably consists of silver halide grains which are not sensitive during imagewise exposure for obtaining a dye image and are not essentially developed during a development step. These silver halide grains are preferably not fogged in advance. In the fine grain silver halide, the content of silver bromide is 0 to 100 mol %, and silver chloride and/or silver iodide can be contained if necessary. The fine grain silver halide preferably contains 0.5 to 10 mol % of silver iodide. The average grain size (the average value of equivalent circle diameters of projected areas) of the fine grain silver halide is preferably 0.01 to 0.5 $\mu$m, and more preferably 0.02 to 0.2 $\mu$m.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be added to this fine grain silver halide grain containing layer.

The silver coating amount of the light-sensitive material of the present invention is 3.2 g/m$^2$ or less, preferably, from 0.5 to 3.2 g/m$^2$ and more preferably 1.0 to 3.2 g/m$^2$. The terminology "silver coating amount" used herein means the total amount of silver, in terms of silver, contained in the light-sensitive material, such as silver halides, black colloidal silver and yellow colloidal silver and etc. The silver coating amount of black colloidal silver is preferably from 0.1 to 1.0 g/m$^2$, more preferably, from 0.2 to 0.8 g/m$^2$ and most preferably from 0.2 to 0.5 g/m$^2$.

Photographic additives usable in the present invention are also described in RDs, and the corresponding portions are summarized in the following table.

| | Types of additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879 |

Various dye forming couplers can be used in the light-sensitive material of the present invention, and the following couplers are particularly preferable.

Yellow couplers; couplers represented by formulas (I) and (II) in EP 502,424A, couplers represented by formulas (1) and (2) in EP 513,496A (particularly Y-28 on page 18); a coupler represented by formula (I) in claim 1 of EP 568,037A; a coupler represented by formula (I) in column 1, lines 45 to 55, in U.S. Pat. No. 5,066,576; a coupler represented by formula (I) in paragraph 0008 of JP-A-4-274425 whose corresponding U.S. Pplication is now patented to U.S. Pat. No. 5,296,339; couplers described in claim 1 on page 40 in EP 498,381A1 (particularly D-35 on page 18); couplers represented by formula (Y) on page 4 in EP 447,969A1 (particularly Y-1 (page 17) and Y-54 (page 41)); and couplers represented by formulas (II) to (IV) in column 7, lines 36 to 58, in U.S. Pat. No. 4,476,219 (particularly II-17, II-19 (column 17), and II-24 (column 19)). The disclosures of all the above mentioned references disclosing the yellow couplers are herein incorporated by reference.

Magenta couplers; JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP 456,257; M-4 and M-6 (page 26), and-M-7 (page 27) in EP 486,965; M-45 (page 19) in EP 571,959A; (M-1) (page 6) in JP-A-5-204106; and M-22 in paragraph 0237 of JP-A-4-362631. The disclosures of all the above mentioned references disclosing the magenta couplers are herein incorporated by reference.

Cyan couplers; CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385. The disclosures of all the above mentioned references disclosing the cyan couplers are herein incorporated by reference.

Polymer couplers; P-1 and P-5 (page 11) in JP-A-2-44345, the disclosure of which is herein incorporated by reference.

Couplers for forming a colored dye with a proper diffusibility are preferably those described in U.S. Pat. No. 4,366,237, GB 2,125,570, EP 96,873B, and DE 3,234,533, the disclosures of which are herein incorporated by reference.

Couplers for correcting unnecessary absorption of a colored dye are preferably yellow colored cyan couplers represented by formulas (CI), (CII), (CIII), and (CIV) described on page 5 in EP 456,257A1 (particularly YC-86 on page 84); yellow colored magenta couplers ExM-7 (page 202), Ex-1 (page 249), and EX-7 (page 251) described in EP 456, 257A1; magenta colored cyan couplers CC-9 (column 8) and CC-13 (column 10) described in U.S. Pat. No. 4,833, 069; (2) (column 8) in U.S. Pat. No. 4,837,136; and colorless masking couplers represented by formula (A) in claim 1 of WO 92/11575 (particularly compound examples on pages 36 to 45). The disclosures of all the references disclosing the couplers for correcting unnecessary absorption of a colored dye are herein incorporated by reference.

Examples of compounds (including a coupler) which react with a oxidised product of a developing agent to thereby release a photographically useful compound residue are as follows, and the disclosures of all the below mentioned references are herein incorporated by reference. Development inhibitor release compounds: compounds represented by formulas (I), (II), (III), and (IV) on page 11 of EP 378,236A1 (particularly T-101 (page 30), T-104 (page 31), T-113 (page 36), T-131 (page 45), T-144 (page 51), and T-158 (page 58)), a compound represented by formula (I) on page 7 of EP 436,938A2 (particularly D-49 (page 51)), a compound represented by formula (1) in EP 568,037A (particularly (23) (page 11)), and compounds represented by formulas (I), (II), and (III) on pages 5 and 6 of EP 440, 195A2 (particularly I-(1) on page 29); bleaching accelerator-releasing compounds: compounds represented by formulas (I) and (I') on page 5 of EP 310,125A2 (particularly (60) and (61) on page 1), and compounds represented by formula (I) in claim 1 of JP-A-6-59411 (particularly (7) (page 7)); ligand-releasing compounds: compounds represented by LIG-X described in claim 1 of U.S. Pat. No. 4,555,478 (particularly compounds in column 12, lines 21 to 41); leuco dye-releasing compounds: compounds 1 to 6 in columns 3 to 8 of U.S. Pat. No. 4,749,641; fluorescent dye-releasing compounds: compounds represented by COUP-DYE in claim 1 of U.S. Pat. No. 4,774,181 (particularly compounds 1 to 11 in columns 7 to 10); development accelerator- or fogging agent-releasing compounds: compounds represented by formulas (1), (2), and (3) in column 3 of U.S. Pat. No. 4,656,123 (particularly (I-22) in column 25), and ExZK-2 on page 75, lines 36 to 38, in EP 450,637A2; and compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidation product scavengers: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)); stain inhibitors: formulas (I) to (III) on page 4, lines 30 to 33, particularly I-47, I-72, III-1, and III-27 (pages 24 to 48) in EP 298321A; decoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP 298321A, II-1 to III-23, particularly III-10, in columns 25 to 38 of U.S. Pat. No. 5,122,444, I-1 to III-4, particularly II-2, on pages 8 to 12 in EP 471347A, and A-1 to A-48, particularly A-39 and A-42, in columns 32 to 40 of U.S. Pat. No. 5,139,931; materials which reduce the use amount of a color enhancer or a color-mixing inhibitor: I-1 to II-15, particularly I-46, on pages 5 to 24 in EP 411324A; formalin scavengers: SCV-1 to SCV-28, particularly SCV-8, on pages 24 to 29 in EP 477932A; film hardeners: H-1, H-4, H-6, H-8, and H-14 on page 17 in JP-A-1-214845, compounds (H-1 to H-54) represented by formulas (VII) to (XII) in columns 13 to 23 of U.S. Pat. No. 4,618,573, compounds (H-1 to H-76), particularly H-14, represented by formula (6) on page 8, lower right column, in JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7, of U.S. Pat. No. 5,019,492; antiseptic agents and mildewproofing agents; I-i to III-43, particularly II-1, II-9, II-10, II-18, and III-25, in columns 3 to 15 of U.S. Pat. No. 4,923,790; stabilizers and antifoggants: I-1 to (14), particularly I-1, I-60, (2), and (13), in columns 6 to 16 of U.S. Pat. No. 4,923,793, and compounds 1 to 65, particularly compound 36, in columns 25 to 32 of U.S. Pat. No. 4,952,483; chemical sensitizers: triphenylphosphine selenide, and compound 50 in JP-A-5-40324; dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450, F-I-1 to F-II-43, particularly F-I-11 and F-II-8, on pages 33 to 55 in EP 445627A, III-1 to III-36, particularly III-1 and III-3, on pages 17 to 28 in EP 457153A, fine crystal dispersions of Dye-1 to Dye-124 on pages 8 to 26 in WO 88/04794, compounds 1 to 22, particularly compound 1, on pages 6 to 11 in EP 319999A, compounds D-1 to D-87 (pages 3 to 28) represented by formulas (1) to (3) in EP 519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; and UV absorbents: compounds (18b) to (18r) and 101 to 427 (pages 6 to 9) represented by formula (1) in JP-A-46-3335, compounds (3) to (66) (pages 10 to 44) represented by formula (I) and compounds HBT-1 to HBT-10 (page 14) represented by formula (III) in EP 520938A, and compounds (1) to (31) (columns 2 to 9) represented by formula (1) in EP 521823A.

The light-sensitive material of the present invention can be applied to various color light-sensitive materials such as color negative films for general purposes or cinemas, color reversal films for slides and TV, color paper, color positive films and color reversal paper. Moreover, the light-sensitive material of the present invention is suitable to lens equipped film units described in JP-B-2-32615 and Japanese Utility Model Application KOKOKU Publication No. 3-39784.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the total sum of film thicknesses of all hydrophilic colloid layers on the side having emulsion layers is 28 $\mu$m or less, preferably 23 $\mu$m or less, more preferably 18 $\mu$m or less, and most preferably 16 $\mu$m or less. A film swelling speed $T_{1/2}$ is preferably 30 sec or less, and more preferably, 20 sec or less. $T_{1/2}$ is herein defined by the time required to become the thickness of the film to one half of a saturated film thickness The saturated film thickness is 90% of the maximum swollen thickness reached after the processing by a developer at 30° C. for 3 minutes and 15 seconds. The film thickness means a film thickness measured under moisture conditioning at a temperature of 25° C. and a relative humidity of 55% (two days). The film swelling speed $T_{1/2}$ can be measured by using a swelling meter described in A. Green et al., Photogr. Sci. Eng., Vol. 19, No. 2, pp. 124 to 129. The film swelling speed $T_{1/2}$ can be regulated by adding a film hardening agent to gelatin as a binder or changing aging conditions after coating. The swelling ratio preferably ranges from 150 to 400%. The swelling ratio can be calculated from the maximum swollen film thickness measured under the above conditions in accordance with the formula:

[maximum swollen film thickness−film thickness]/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swelling ratio of the back layers is preferably 150% to 500%.

The light-sensitive material according to the present invention can be developed by conventional methods described in RD. No. 17643, pp. 28 and 29, RD. No. 18716, page 651, the left to right columns, and RD No. 307105, pp. 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are, for example, 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol and most preferably 0.02 to 0.05 mol per liter of the color developing solution. The replenisher of the color developing solution preferably contains the color developing agent in an amount corresponding to 1.1 to 3 times each of the above concentrations and more preferably 1.3 to 2.5 times each of the above concentrations.

Hydroxyamine can widely be used as preservatives of the color developing solution. When enhanced preserving properties are required, it is preferred to use hydroxyamine derivatives having substituents such as alkyl, hydroxyalkyl, sulfoalkyl and carboxyalkyl groups, examples of which include N,N-di(sulfoehtyl)hydroxyamine, monomethylhydroxyamine, dimethylhydroxyamine, monoethylhydroxyamine, diethylhydroxyamine and N,N-di(carboxyethyl)hydroxyamine. Of these, N,N-di(sulfoehtyl) hydroxyamine is most preferred. Although these may be used in combination with the hydroxyamine, it is preferred that one or at least two members thereof be used in place of the hydroxyamine.

These preservatives are preferably used in an amount of 0.02 to 0.2 mol, more preferably 0.03 to 0.15 mol and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used in the color developing solution as oxide tarring preventives for the color developing agent. Each sulfurous salt is preferably used in the color developing solution in an amount of 0.01 to 0.05 mol and more preferably 0.02 to 0.04 mol per liter and is preferably used in the replenisher in an amount corresponding to 1.1 to 3 times the above concentration.

The pH value of the color developing solution preferably ranges from 9.8 to 11.0 and more preferably from 10.0 to 10.5. That of the replenisher is preferably set at 0.1 to 1.0 higher than the above range. Common buffers such as carbonic salts, phosphoric salts, sulfosalicylic salts and boric salts are used for stabilizing the above pH value.

The amount of the replenisher of the color developing solution preferably ranges from 80 to 1300 mL per $m^2$ of the light-sensitive material. It is desired that the amount be smaller from the viewpoint of reducing environmental pollution load. Specifically, the amount of the replenisher more preferably ranges from 80 to 600 mL and most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/liter),

A: target bromide ion concentration of the color developing solution (mol/liter), W: amount of bromide ion leached from the light-sensitive material into the color developing solution when a color development of 1 $m^2$ of the light-sensitive material has been carried out (mol), and V: amount of color developing replenisher supplied per $m^2$ of the light-sensitive material (liter).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of the compound of specific example 1 listed on page 7 of JP-A-5-173312.

For improving the biodegradability of the bleaching agent, it is preferred that ferric complex salts of compounds listed in JP-A-4-251845, JP-A-4-268552, EP 588,289, EP 591,934 and JP-A-6-208213 be used as the bleaching agent. The concentration of the above bleaching agent preferably ranges from 0.05 to 0.3 mol per liter of the solution having bleaching capability, and it is especially preferred to design the solution at the concentrations of 0.1 to 0.15 mol per liter for reducing the discharge to the environment. When the solution having bleaching capability is a bleaching solution, a bromide is preferably incorporated therein in an amount of 0.2 to 1 mol and more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V_1+V_2)/V_1+C_P$$

$C_R$: concentration of the component in the replenisher, $C_T$: concentration of the component in the mother liquor (processing tank solution), $C_P$: component concentration consumed during processing, $V_1$: amount of replenisher having bleaching capability supplied per $m^2$ of light-sensitive material (mL), and $V_2$: amount carried over from previous bath by 1 $m^2$ of light-sensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably, 80 to 500 mL and, most preferably, 100 to 300 mL of a bleaching replenisher per $m^2$ of the light-sensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilverability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably, 150 to 700 mL and, more preferably, 200 to 600 mL per $m^2$ of the light-sensitive material.

Silver is preferably recovered by installing any of various silver recovering devices in an inline or offline mode in the bleach-fix or fixation step. Inline installation enables processing with the silver concentration of the solution lowered, so that the amount of replenisher can be reduced. It is also suitable to conduct an offline silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5 and more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

The contents of the descriptions on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP 504,609 and EP 519,190 and N-methylolazoles described in JP-A-4-362943 in place of formaldehyde and the dimerization of magenta coupler to form a two-equivalent coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the light-sensitive material.

The replenishing amount of water washing and stabilizing solutions is preferably in the range of 80 to 1000 mL, more preferably 100 to 500 mL and most preferably 150 to 300 mL per $m^2$ of the light-sensitive material from the viewpoint that water washing and stabilizing functions are ensured and that the amount of waste solution is reduced to contribute to environment protection. In the processing with the above replenishing amount, known mildewproofing agents such as thiabendazole, 1,2-benzoisothiazolin-3-one and 5-chloro-2-methylisothiazolin-3-one, antibiotics such as gentamicin and water deionized by the use of, for example, an ion exchange resin are preferably used for preventing the breeding of bacteria and mildew. The use of deionized water, a mildewproofing agent and an antibiotic in combination is more effective than individual uses.

With respect to the solution placed in the water washing or stabilizing solution tank, it is also preferred that the replenishing amount be reduced by conducting a reverse osmosis membrane treatment described in JP-A-3-46652, JP-A-3-53246, JP-A-3-55542, JP-A-3-121448 and JP-A-3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method is preferred in which a correction is effected with the use of information on the temperature and humidity of developing machine installation environment in accordance with Formula 1 on page 2 thereof. Water for use in the evaporation correction is preferably harvested from the water washing replenishing tank. In that instance, deionized water is preferably used as the water washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent for use in the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A-4-19655 and JP-A-4-230748, granules containing a water soluble polymer in JP-A-4-221951, tablets in JP-A-51-61837 and JP-A-6-102628 and a paste processing agent in PCT National Publication 57-500485. Although any of these can be suitably used, it is preferred to use a liquid prepared in the same concentration as in use from the viewpoint of easiness in use.

The container for storing the above processing agent is composed of, for example, any or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the molding of the container in a thickness of 500 to 1500 $\mu$m so that the oxygen permeability therethrough is 20 mL/m$^2$·24·hrs-atom or less.

The processing solution for color reversal film to be employed in the present invention will be described below.

With respect to the processing for color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied.

In the color reversal film processing, an image stabilizer is added to a conditioning bath or a final bath. Examples of the image stabilizers include formalin, formaldehyde sodium bisulfite and N-methylolazoles. Formaldehyde sodium bisulfite and N-methylolazoles are preferred from the viewpoint of working environment. Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The magnetic recording layer for use in the present invention will be described below.

The magnetic recording layer for use in the present invention comprises a support coated with an aqueous or organic solvent coating fluid having magnetic grains dispersed in a binder.

The magnetic material grains for use in the present invention can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific area is preferably at least 20 m$^2$/g and more preferably at least 30 m$^2$/g in terms of SBET. The saturation magnetization ($\sigma$s) of the ferromagnetic material preferably ranges from $3.0\times10^4$ to $3.0\times10^5$ A/m, more preferably, from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A-4-259911 and JP-A-5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2,000 to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane) and polyisocyanates produced by condensation of these isocyanates, as described in, for example, JP-A-6-59357.

The above magnetic material is preferably dispersed in the above binder by the method described in JP-A-6-35092 in which a kneader, a pin type mill and an annular type mill are used either individually or in combination. Dispersants listed in JP-A-5-088283 and other common dispersants can be used. The thickness of the magnetic recording layer generally ranges from 0.1 to 10 $\mu$m, preferably, 0.2 to 5 $\mu$m and more preferably from 0.3 to 3 $\mu$m. The weight ratio of magnetic material grains to binder is preferably in the range of 0.5:100 to 60:100 and more preferably 1:100 to 30:100.

The coating amount of magnetic material grains ranges from 0.005 to 3 g/m$^2$, preferably, from 0.01 to 2 g/m$^2$ and more preferably from 0.02 to 0.5 g/m$^2$. The transmission yellow density of the magnetic recording layer is preferably in the range of 0.01 to 0.50, more preferably, 0.03 to 0.20 and most preferably from 0.04 to 0.15. The magnetic recording layer can be applied to a back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating fluids set forth in JP-A-5-341436 are preferably used.

The magnetic recording layer may also be provided with lubricity enhancing, curl regulating, antistatic, antiadhesive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the magnetic recording layer binder. The sensitive material having the magnetic recording layer is described in U.S. Pat. No. 5,336,589, U.S. Pat. No. 5,250,404, U.S. Pat. No. 5,229,259, U.S. Pat. No. 5,215,874 and EP 466,130.

The polyester support employed in the present invention when the magnetic recording layer is arranged will be described below. Particulars thereof together with the below mentioned sensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of the aromatic dicarboxylic acids include 2,6-, 1,5-, 1,4- and 2,7-naphthalenedicarboxylic acids, terephthalic acid, isophthalic acid and phthalic acid, and Examples of the diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., more preferably, at least 90° C.

The polyester support is subjected to heat treatment at a temperature of 40° C. to less than Tg, preferably, Tg minus 20° C. to less than Tg in order to suppress curling. This heat treatment may be conducted at a temperature held constant within the above temperature range or may be conducted while cooling. The period of heat treatment ranges from 0.1 to 1500 hr, preferably, 0.5 to 200 hr. The support may be heat treated either in the form of a roll or while being carried in the form of a web. The surface form of the support may be improved by rendering the surface rough (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the light-sensitive material of the present invention in which the magnetic recording layer is used, a surface treatment is preferably conducted for bonding a support and a sensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The undercoating method will be described below. The undercoating may be composed of either a single layer or at least two layers. Use is made of an undercoating layer binder of, for example, a copolymer prepared from monomers as starting materials selected from among vinyl chloride, vinylidene chloride, butadiene, methacrylic acid, acrylic acid, itaconic acid and maleic anhydride, polyethyleneimine, an epoxy resin, a grafted gelatin, nitrocellulose or gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the undercoating layer. Also, $SiO_2$ or $TiO_2$ inorganic fine grains or polymethyl methacrylate copolymer fine grains (0.01 to 10 $\mu$m) may be incorporated therein as a matting agent.

An antistatic agent is preferably used in the present invention in which the magnetic recording layer is employed. Examples of the antistatic agents include carboxylic acids and carboxylic salts, sulfonic salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably, $10^5$ Ω·cm or less and having a grain size of 0.001 to 1.0 $\mu$m or a composite oxide thereof (Sb, P, B, In, S, Si, C, etc.) and fine grains of sol form metal oxides or composite oxides thereof.

The content thereof in the sensitive material is preferably in the range of 5 to 500 mg/m$^2$, more preferably, 10 to 350 mg/m$^2$. The ratio of amount of conductive crystalline oxide or composite oxide thereof to binder is preferably in the range of 1/300 to 100/1, more preferably, 1/100 to 100/5.

It is preferred that the sensitive material of the present invention having the magnetic recording layer have lubricity. The lubricant containing layer is preferably provided on both the light-sensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the light-sensitive layer side.

The lubricant which can be used in the present invention employing the magnetic recording layer is, for example, a polyorganosiloxane, a higher fatty acid amide, a higher fatty acid metal salt and an ester of higher fatty acid and higher alcohol. Examples of the polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the sensitive material of the present invention employing the magnetic recording layer. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, polymethyl methacrylate/methacrylic acid (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 $\mu$m or less be simultaneously added, which include, for example, fine grains of polymethyl methacrylate (0.2 $\mu$m), poly(methyl methacrylate/methacrylic acid) (9/1 in molar ratio, 0.3 $\mu$m), polystyrene grains (0.25 $\mu$m) and colloidal silica (0.03 $\mu$m).

The film patrone for use in the present invention employing the magnetic recording layer will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably further contain, for example, carbon black, metal oxide grains, nonionic, anionic, cationic or betaine type surfactants and polymers. Such an antistatic patrone is described in JP-A-1-312537 and JP-A-1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably, 25 $cm^3$ or less. The weight of the plastic used in each patrone or patrone case preferably ranges from 5 to 15 g.

The patrone for use in the present invention employing the magnetic recording layer may be one capable of feeding a film out by rotating a spool. 10F Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. No. 4,834,306 and U.S. Pat. No. 5,226,613. The photographic film for use in the present invention may be a generally so termed raw stock having not yet been developed or a developed photographic film. The raw stock and the developed photographic film may be accommodated in the same new patrone or in different patrones.

The color photographic light-sensitive material of the present invention employing the magnetic recording layer is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series (e.g., Epion 300Z) produced by Fuji Film and put to practical use. Moreover, the color photographic light-sensitive material of the present invention is suitable to a lens equipped film such as Fuji Color Uturundesu Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is, preferably, Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP362B or AL, and recommended processing chemical is Fuji Color Just It CN-16L or CN-16Q. Printer processor is, for example, PP3008AR/PP3008A/PP1828AR/PP1828A/PP1258AR/PP1258A/PP728AR/PP728A, and recommended processing chemical thereof is Fuji Color Just It CP-47L or CP-40FAII. Scanner & image processor SP-1000 and laser printer & paper processor LP-1000P or laser printer LP-100OW are used in the Frontier system. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by means of existent labo equipment, for example, by digital color printer NC-550AL based on photofixing type thermal color printing system or Pictography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high velocity. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

EXAMPLES

The present invention will be described in more detail below by way of its examples. However, the present invention is not limited to these examples as long as the invention does not depart from the gist of the invention.

Example 1

A cellulose triacetate film of 122 gm in thickness provided with a subbing layer was given the following coatings, thereby preparing sample 101.

(Composition of light-sensitive layer)

Main materials for use in each layer are classified as follows:

ExC: cyan coupler
UV: ultraviolet absorber
ExM: magenta coupler
HBS: high b.p. organic solvent
ExY: yellow coupler
H: gelatin hardener
ExS: spectral sensitizing dye.

The figure given beside the description of each component is for the coating amount expressed in the unit of g/m$^2$. With respect to a silver halide, the coating amount is in terms of silver, provided that, regarding the spectral sensitizing dye, the coating amount is expressed in the unit of mol per mol of silver halide present in the same layer.

(Sample 101)

| | | |
|---|---|---|
| 1st layer (1st antihalation layer) | | |
| Gelatin | | 0.11 |
| 2nd layer (2nd antihalation layer) | | |
| Black colloidal silver | silver | 0.25 |
| Gelatin | | 0.25 |
| ExM-1 | | 0.10 |
| ExF-1 | | $2.0 \times 10^{-3}$ |
| Solid disperse dye ExF-2 | | 0.030 |
| Solid disperse dye ExF-3 | | 0.040 |
| HBS-1 | | 0.15 |
| HBS-2 | | 0.02 |
| 3rd layer (Interlayer) | | |
| Silver iodobromide emulsion N | silver | 0.06 |
| ExC-2 | | 0.05 |
| Polyethyl acrylate latex | | 0.20 |
| Gelatin | | 0.70 |
| 4th layer (Low-speed red-sensitive emulsion layer) | | |
| Silver iodobromide emulsion A | silver | 0.02 |
| Silver iodobromide emulsion B | silver | 0.05 |
| ExS-1 | | $3.3 \times 10^{-4}$ |
| ExS-2 | | $1.4 \times 10^{-5}$ |
| ExS-3 | | $4.6 \times 10^{-4}$ |
| ExC-1 | | 0.11 |
| ExC-2 | | 0.02 |
| ExC-3 | | 0.04 |

-continued

| | | |
|---|---|---|
| ExC-4 | | 0.07 |
| ExC-5 | | 0.020 |
| ExC-6 | | 0.010 |
| ExM-4 | | 0.005 |
| ExY-1 | | 0.01 |
| Cpd-2 | | 0.025 |
| HBS-1 | | 0.10 |
| Gelatin | | 1.10 |
| 5th layer (Medium-speed red-sensitive emulsion layer) | | |
| Silver iodobromide emulsion B | silver | 0.285 |
| Silver iodobromide emulsion C | silver | 0.280 |
| ExS-1 | | $4.2 \times 10^{-4}$ |
| ExS-2 | | $1.8 \times 10^{-5}$ |
| ExS-3 | | $5.9 \times 10^{-4}$ |
| ExC-1 | | 0.18 |
| ExC-2 | | 0.05 |
| ExC-3 | | 0.06 |
| ExC-4 | | 0.07 |
| ExC-5 | | 0.02 |
| ExC-6 | | 0.02 |
| ExM-4 | | 0.02 |
| ExY-1 | | 0.005 |
| Cpd-4 | | 0.02 |
| Cpd-2 | | 0.02 |
| HBS-1 | | 0.10 |
| Gelatin | | 0.80 |
| 6th layer (High-speed red-sensitive emulsion layer) | | |
| Silver iodobromide emulsion D | silver | 0.27 |
| ExS-1 | | $3.5 \times 10^{-4}$ |
| ExS-2 | | $1.5 \times 10^{-5}$ |
| ExS-3 | | $4.9 \times 10^{-4}$ |
| ExC-1 | | 0.02 |
| ExC-2 | | 0.018 |
| ExC-3 | | 0.015 |
| ExC-6 | | 0.001 |
| ExC-7 | | 0.010 |
| ExM-4 | | 0.003 |
| Cpd-2 | | 0.040 |
| Cpd-4 | | 0.040 |
| HBS-1 | | 0.22 |
| HBS-2 | | 0.050 |
| Gelatin | | 1.10 |
| 7th layer (Interlayer) | | |
| Cpd-1 | | 0.060 |
| Solid disperse dye ExF-4 | | 0.030 |
| HBS-1 | | 0.040 |
| Polyethyl acrylate latex | | 0.15 |
| Gelatin | | 1.10 |
| 8th layer (Low-speed green-sensitive emulsion layer) | | |
| Silver iodobromide emulsion E | silver | 0.15 |
| Silver iodobromide emulsion F | silver | 0.10 |
| Silver iodobromide emulsion G | silver | 0.15 |
| ExS-7 | | $7.5 \times 10^{-4}$ |
| ExS-8 | | $3.4 \times 10^{-4}$ |
| ExS-4 | | $2.5 \times 10^{-5}$ |
| ExS-5 | | $9.0 \times 10^{-5}$ |
| ExS-6 | | $4.3 \times 10^{-4}$ |
| ExM-3 | | 0.30 |
| ExM-4 | | 0.09 |
| ExY-1 | | 0.01 |
| ExY-5 | | 0.0020 |
| HBS-1 | | 0.30 |
| HBS-3 | | 0.015 |
| Cpd-4 | | 0.010 |
| Gelatin | | 0.95 |
| 9th layer (Medium-speed green-sensitive emulsion layer) | | |
| Silver iodobromide emulsion G | silver | 0.2 |
| Silver iodobromide emulsion H | silver | 0.2 |
| ExS-4 | | $3.6 \times 10^{-5}$ |
| ExS-7 | | $1.7 \times 10^{-4}$ |
| ExS-8 | | $8.0 \times 10^{-4}$ |
| ExC-8 | | 0.0020 |
| ExM-3 | | 0.12 |
| ExM-4 | | 0.02 |

-continued

| | | |
|---|---|---|
| ExY-1 | | 0.02 |
| ExY-4 | | 0.005 |
| ExY-5 | | 0.002 |
| Cpd-4 | | 0.015 |
| HBS-1 | | 0.13 |
| HBS-3 | | $4.4 \times 10^{-3}$ |
| Gelatin | | 0.80 |
| 10th layer (High-speed green-sensitive emulsion layer) | | |
| Silver iodobromide emulsion I | silver | 0.28 |
| ExS-4 | | $6.3 \times 10^{-5}$ |
| ExS-7 | | $1.7 \times 10^{-4}$ |
| ExS-8 | | $7.8 \times 10^{-4}$ |
| ExC-6 | | 0.01 |
| ExM-4 | | 0.02 |
| ExM-2 | | 0.005 |
| ExM-5 | | 0.001 |
| ExM-6 | | 0.001 |
| ExM-3 | | 0.04 |
| Cpd-3 | | 0.001 |
| Cpd-4 | | 0.040 |
| HBS-1 | | 0.25 |
| Polyethyl acrylate latex | | 0.15 |
| Gelatin | | 1.33 |
| 11th layer (Yellow filter layer) | | |
| Yellow colloidal silver | silver | 0.015 |
| Cpd-1 | | 0.16 |
| Solid disperse dye ExF-5 | | 0.060 |
| Solid disperse dye ExF-6 | | 0.060 |
| Oil-soluble dye ExF-7 | | 0.010 |
| HBS-1 | | 0.60 |
| Gelatin | | 0.60 |
| 12th layer (Low-speed blue-sensitive emulsion layer) | | |
| Silver iodobromide emulsion J | silver | 0.06 |
| Silver iodobromide emulsion K | silver | 0.06 |
| Silver iodobromide emulsion L | silver | 0.15 |
| ExS-9 | | $8.4 \times 10^{-4}$ |
| ExC-1 | | 0.03 |
| ExC-8 | | $7.0 \times 10^{-3}$ |
| ExY-1 | | 0.07 |
| ExY-2 | | 0.72 |
| ExY-3 | | 0.02 |
| ExY-4 | | 0.01 |
| Cpd-2 | | 0.005 |
| Cpd-4 | | 0.005 |
| Cpd-3 | | 0.004 |
| UV-2 | | 0.054 |
| UV-3 | | 0.054 |
| HBS-1 | | 0.28 |
| Gelatin | | 2.60 |
| 13th layer (High-speed blue-sensitive emulsion layer) | | |
| Silver iodobromide emulsion M | silver | 0.24 |
| ExS-9 | | $6.0 \times 10^{-4}$ |
| ExY-2 | | 0.005 |
| ExY-3 | | 0.24 |
| ExY-4 | | 0.0050 |
| Cpd-2 | | 0.10 |
| Cpd-3 | | $1.0 \times 10^{-3}$ |
| Cpd-4 | | $5.0 \times 10^{-3}$ |
| UV-2 | | 0.012 |
| UV-3 | | 0.012 |
| HBS-1 | | 0.075 |
| Gelatin | | 0.55 |
| 14th layer (1st protective layer) | | |
| Silver iodobromide emulsion N | silver | 0.10 |
| UV-1 | | 0.13 |
| UV-2 | | 0.10 |
| UV-3 | | 0.16 |
| UV-4 | | 0.025 |
| ExF-8 | | 0.03 |
| ExF-9 | | 0.005 |
| ExF-10 | | 0.005 |
| ExF-11 | | 0.02 |
| HBS-1 | | $5.0 \times 10^{-2}$ |

-continued

| | | |
|---|---|---|
| HBS-4 | | $5.0 \times 10^{-2}$ |
| Gelatin | | 1.8 |
| 15th layer (2nd protective layer) | | |
| H-1 | | 0.40 |
| B-1 (diameter 1.7 μm) | | 0.04 |
| B-2 (diameter 1.7 μm) | | 0.09 |
| B-3 | | 0.13 |
| ES-1 | | 0.20 |
| Gelatin | | 0.70 |

In addition to the above components, W-1 to W-3, B-4 to B-6, F-1 to F-18, iron salt, lead salt, gold salt, platinum salt, palladium salt, iridium salt, and rhodium salt were appropriately added to the individual layers in order to improve the storage stability, processability, resistance to pressure, antiseptic and mildewproofing properties, antistatic properties, and coating properties.

TABLE 1

| Emulsion | Average AgI content (mol %) | Average equivalent spherical diameter (μm) | Coefficience of variation of the diameter (%) | Equivalent circular diameter of the projected area (μm) | Diameter/thickness ratio | Tabularity |
|---|---|---|---|---|---|---|
| Emulsion A | 2.8 | 0.28 | 13 | 0.28 | 1.5 | 8 |
| Emulsion B | 1.7 | 0.43 | 19 | 0.58 | 3.2 | 18 |
| Emulsion C | 5.0 | 0.55 | 20 | 0.86 | 6.2 | 45 |
| Emulsion D | 5.4 | 0.66 | 23 | 1.10 | 1.0 | 45 |
| Emulsion E | 2.8 | 0.28 | 13 | 0.28 | 1.5 | 8 |
| Emulsion F | 1.7 | 0.43 | 19 | 0.58 | 3.2 | 18 |
| Emulsion G | 5.4 | 0.55 | 20 | 0.86 | 6.2 | 45 |
| Emulsion H | 5.4 | 0.66 | 23 | 1.10 | 1.0 | 45 |
| Emulsion I | 5.4 | 0.72 | 23 | 1.10 | 6.3 | 36 |
| Emulsion J | 3.7 | 0.37 | 19 | 0.55 | 4.6 | 38 |
| Emulsion K | 3.7 | 0.37 | 19 | 0.55 | 4.6 | 38 |
| Emulsion L | 8.8 | 0.64 | 23 | 0.85 | 1.2 | 32 |
| Emulsion M | 6.8 | 0.88 | 30 | 1.12 | 4.7 | 20 |
| Emulsion N | 1.0 | 0.07 | — | — | 1.0 | — |

In Table 1, (1) Emulsions J to M were subjected to a reduction sensitization using thiourea dioxide and thiosulfonic acid during grain preparation in accordance with Examples of JP-A-2-191938;

(2) Emulsions C to E, G to I and M, were subjected to gold sensitization, sulfur sensitization and selenium sensitization in the presence of the spectral sensitizing dyes and sodium thiocyanate described in each light-sensitive layer in accordance with Examples of JP-A-3-237450;

(3) In the preparation of tabular grains, low molecular weight gelatin was used in accordance with Examples of JP-A-1-158426;

(4) Dislocation lines as described in JP-A-3-237450 were observed in tabular grains by means of a high voltage electron microscope; and (5) Emulsions A to E, G, H and J to M contained optimum amounts of Rh, Ir and Fe, and the tabularity is defined as $Dc/t^2$ wherein Dc represents an average equivalent circular diameter of the projected area of tabular grains and t represents an average thickness of tabular grains.

Preparation of dispersions of organic solid disperse dyes:

ExF-2 was dispersed by the following method. That is, 21.7 mL of water, 3 mL of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were placed in a 700-mL pot mill, and 5.0 g of the dye ExF-2 and 500 mL of zirconium oxide beads (diameter 1 mm) were added to the mill. The contents were dispersed for 2 hr. This dispersion was conducted by using a BO type oscillating ball mill manufactured by Chuo Koki K.K. Thereafter, the contents were removed from the mill and added to 8 g of a 12.5% aqueous solution of gelatin. The beads were removed from the resultant material by filtration, obtaining a gelatin dispersion of the dye.

The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by the microprecipitation dispersion method described in Example 1 of EP 549,489A. The average grain size was found to be 0.06 μm.

Chemical structures and etc. of the compounds used in Examples are set forth below.

ExC-1

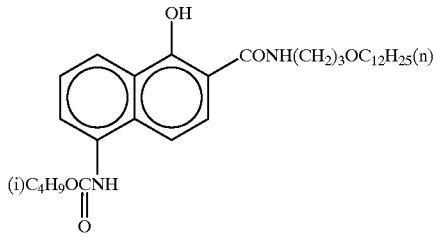

ExC-2

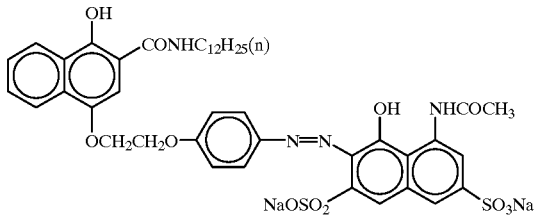

ExC-3

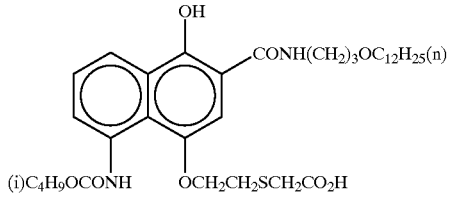

ExC-4

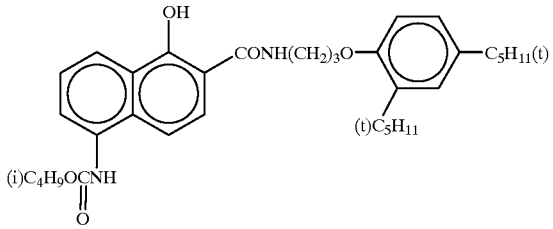

ExC-5

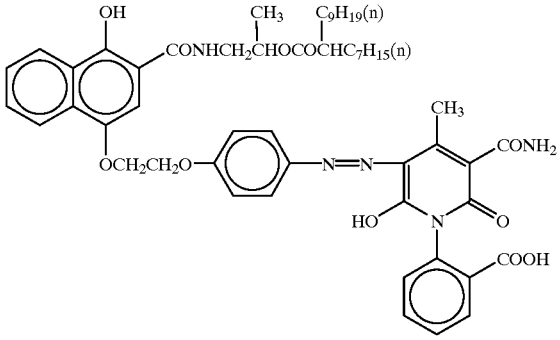

ExC-6

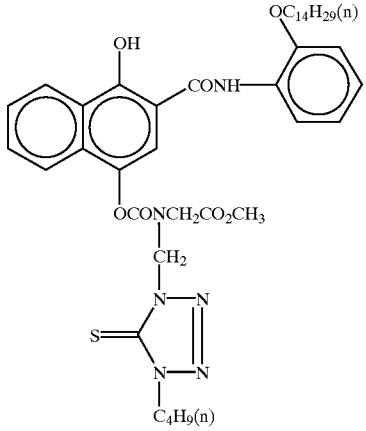

-continued
ExC-7
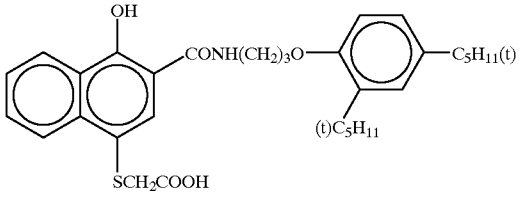
ExC-8
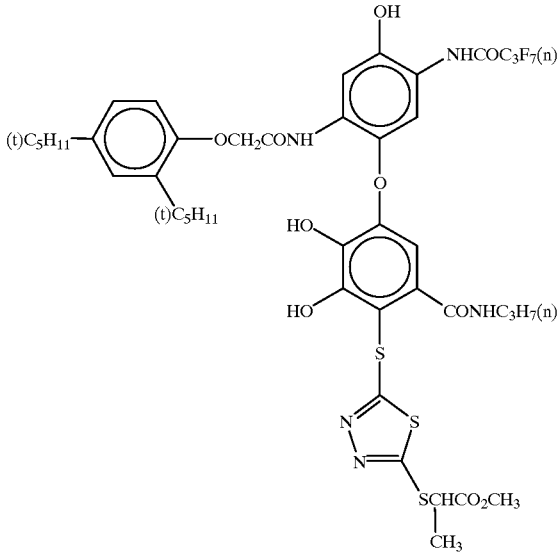
ExM-1
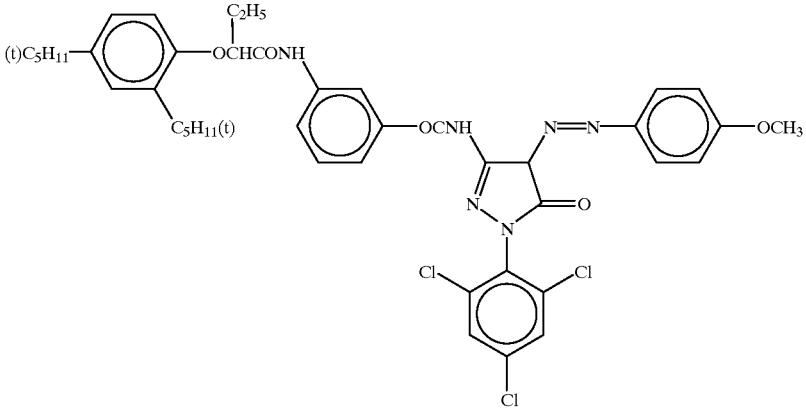
ExM-2
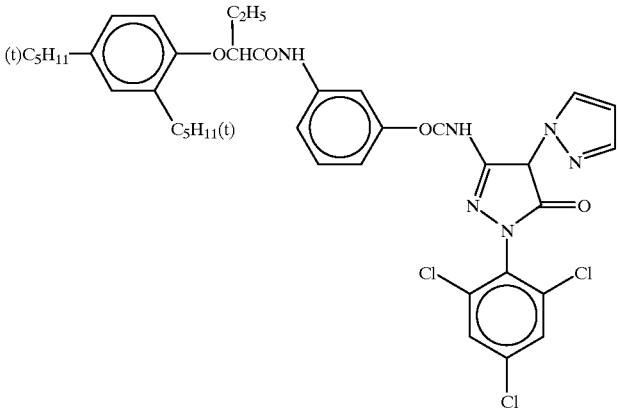

-continued
ExM-3
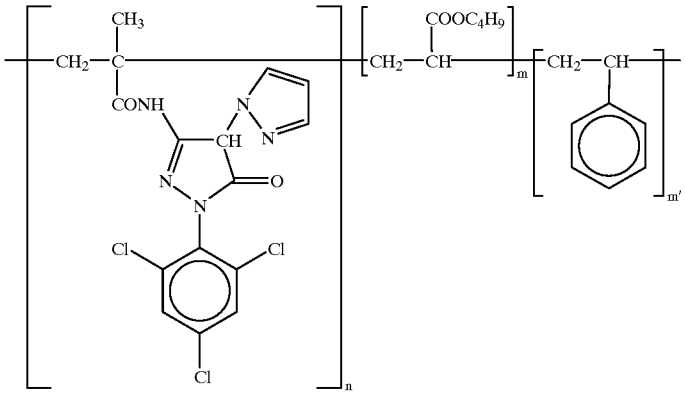
n = 50
m = 25
m′ = 25
mol. wt. about 20,000
ExM-4
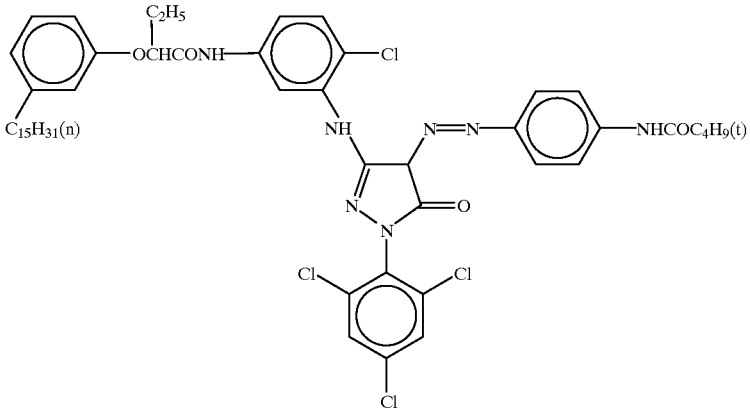
ExM-5
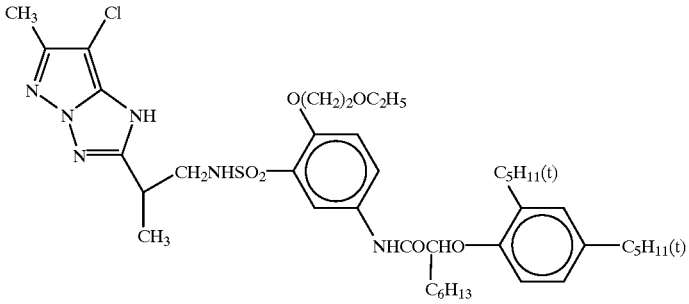
ExM-6
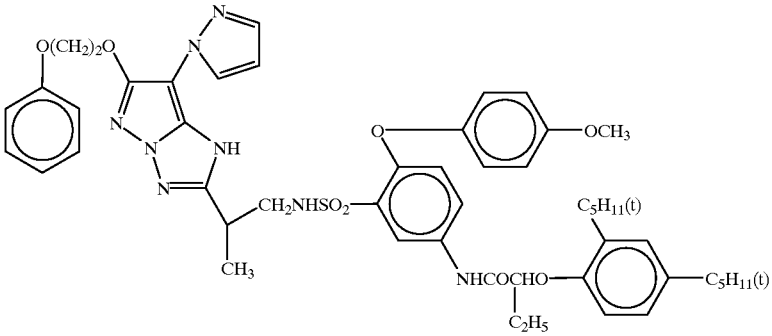

-continued
ExY-1
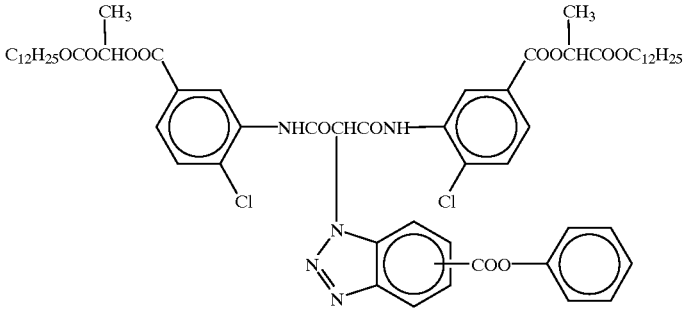
ExY-2
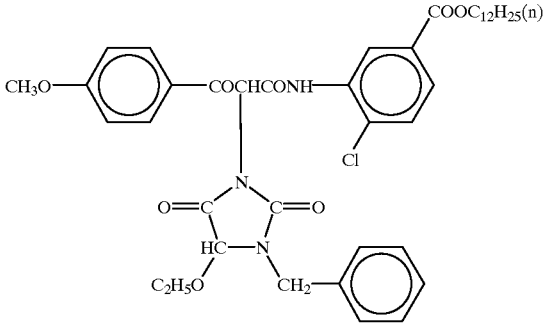
ExY-3
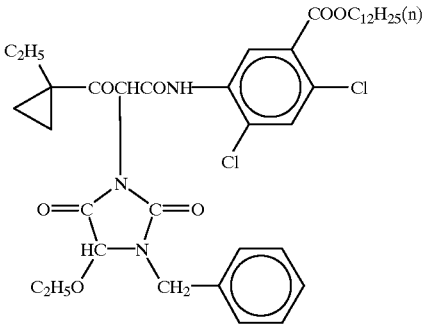
ExY-4
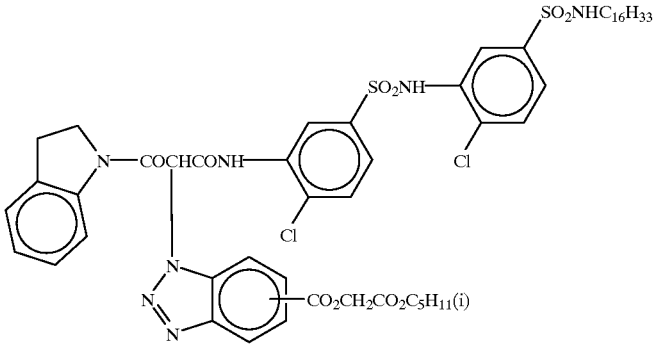
ExY-5
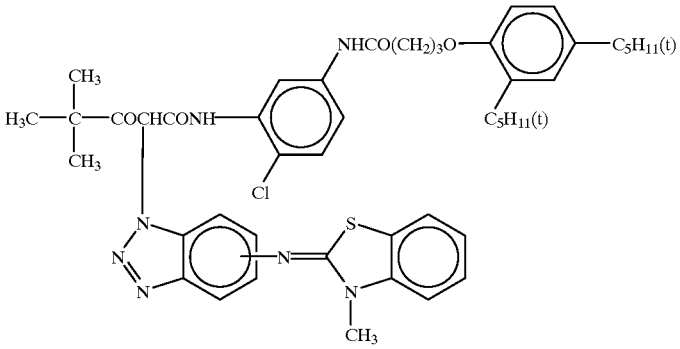

-continued
ExF-1
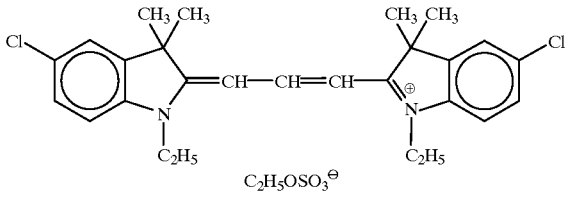
ExF-2
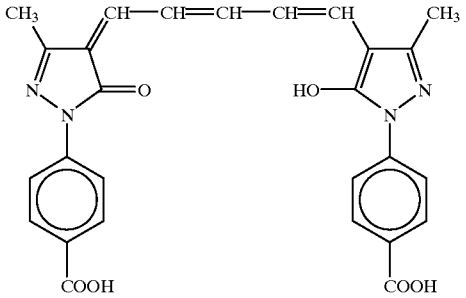
ExF-3
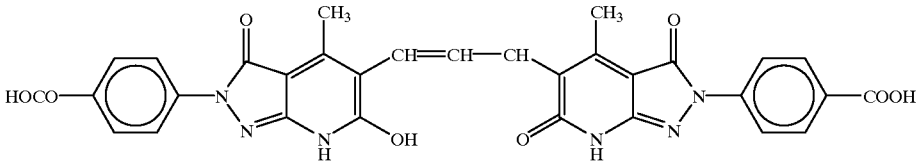
ExF-4
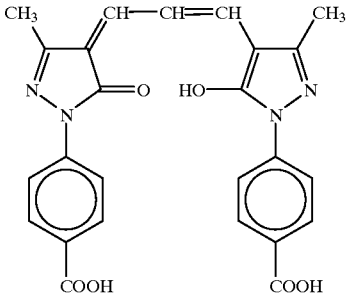
ExF-5
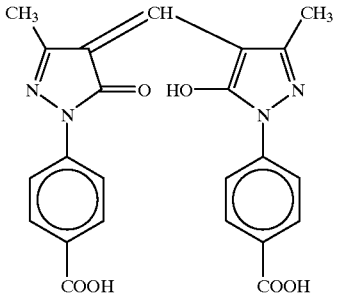
ExF-6
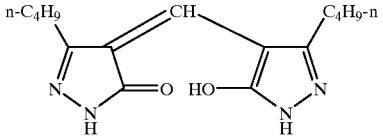
ExF-7
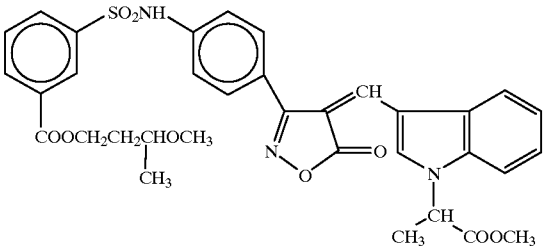
ExF-8
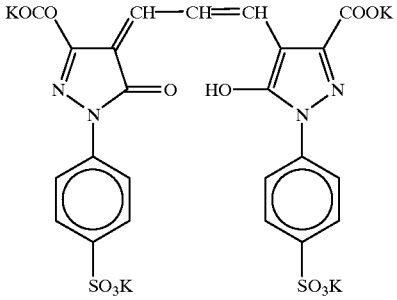
ExF-9
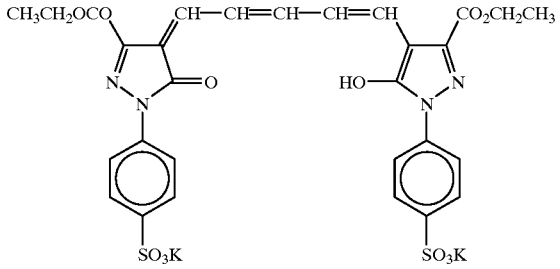

-continued
ExF-10
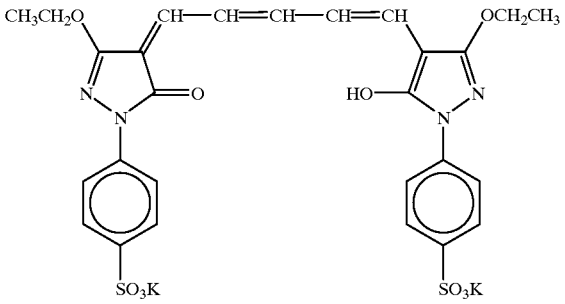
ExF-11
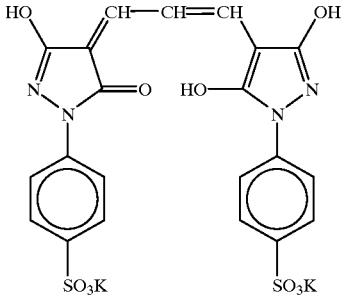
Cpd-1
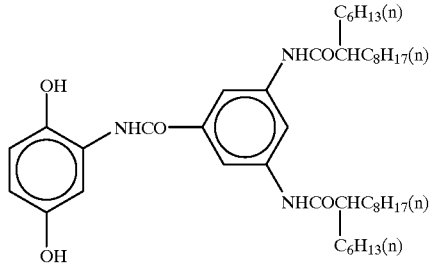
Cpd-2
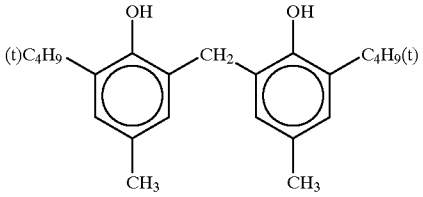
Cpd-3
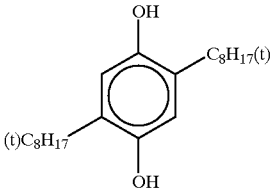
Cpd-4
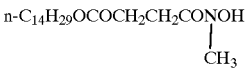
UV-1
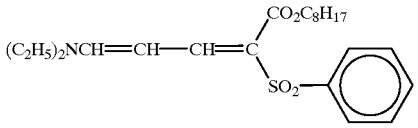
UV-2
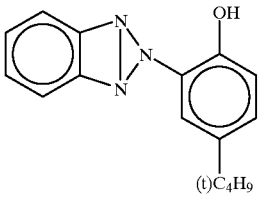
UV-3
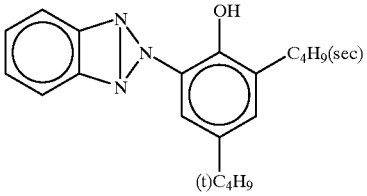
UV-4
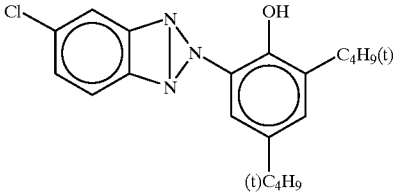
HBS-1
Tricresyl phosphate
HBS-2
Di-n-butyl phthalate
HBS-3
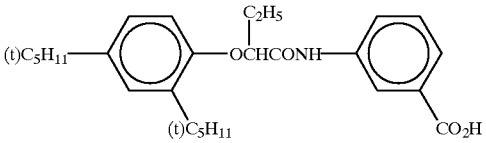
HBS-4
Tri(2-ethylhexyl) phosphate -continued
ExS-1
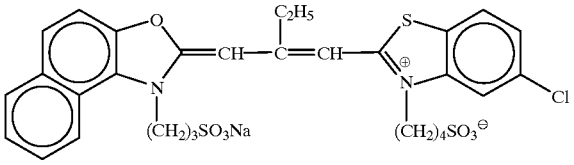
ExS-2
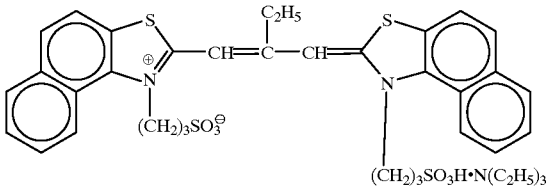
ExS-3
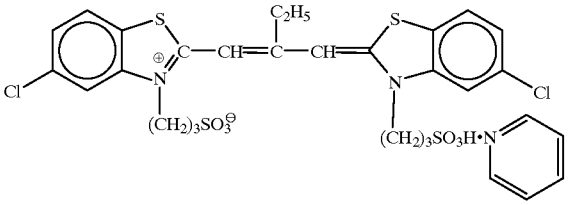
ExS-4
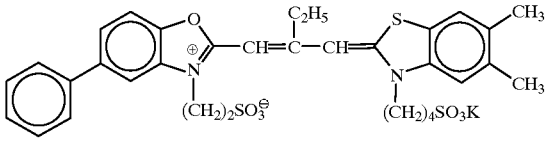
ExS-5
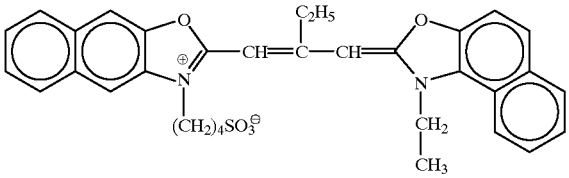
ExS-6
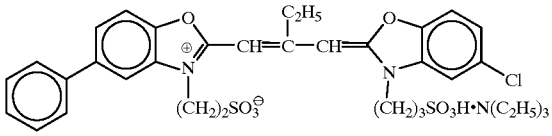
ExS-7
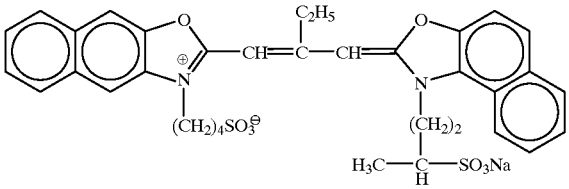
ExS-8
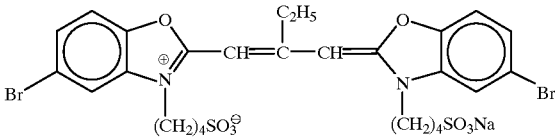
ExS-9
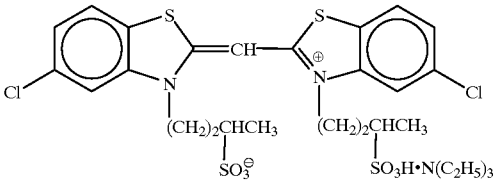
ES-1
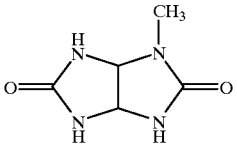
H-1
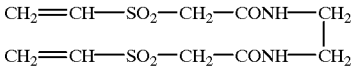
B-1
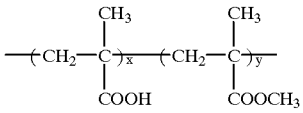
x/y = 10/90
Average molecular Weight:
about 35,000
B-2
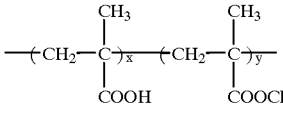
x/y = 45/55
Average molecular Weight:
about 20,000
B-3
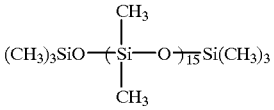
B-4
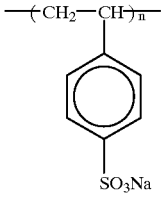
Average molecular Weight:
about 750,000
B-5
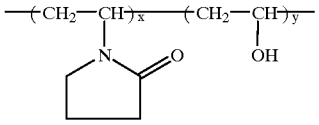
x/y = 70/30
Average molecular Weight:
about 17,000

-continued
B-6
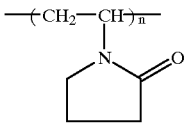
Average molecular Weight: about 10,000
W-1
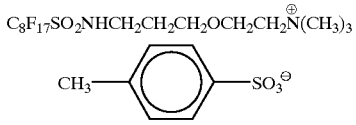
W-2
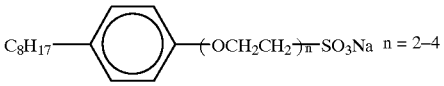
n = 2–4
W-3
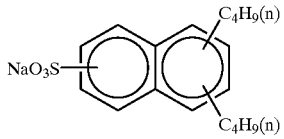
F-1
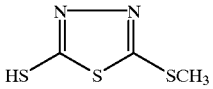
F-2
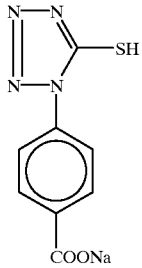
F-3
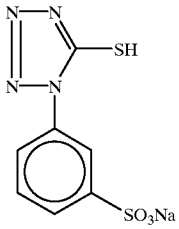
F-4
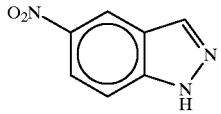
F-5
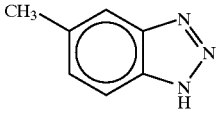
F-6
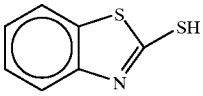
F-7
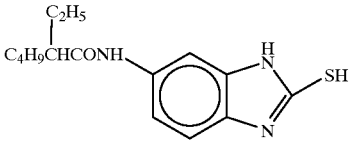
F-8
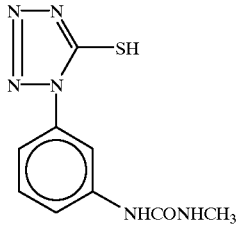
F-9
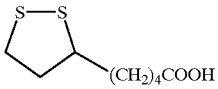
F-10
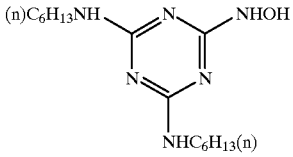
F-11
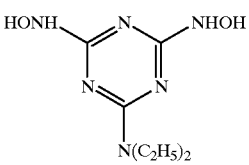
F-12
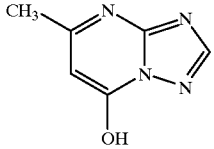

-continued

F-13

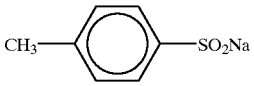

F-14

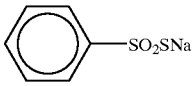

F-15

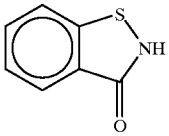

F-16

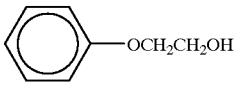

F-17

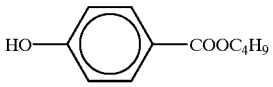

F-18

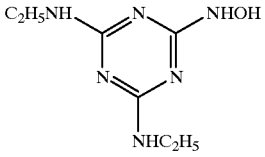

Preparation of Samples 103 to 112:

Sample 103 was prepared in the same manner as in Sample 101, except that black colloidal silver was added to 1st layer of Sample 101, in an amount of 0.12 g/m$^2$.

Sample 104 was prepared in the same manner as in Sample 101, except that Compound (1), which is set forth above, in a state of solid fine grains was added to 1st layer of Sample 101, in an amount of 0.009 g/m$^2$.

Sample 105 was prepared in the same manner as in Sample 104, except that the amount of Compound (1) was changed to 0.017 g/m$^2$.

Sample 106 was prepared in the same manner as in Sample 104, except that the amount of Compound (1) was changed to 0.027 g/m$^2$.

Sample 107 was prepared in the same manner as in Sample 104, except that the amount of Compound (1) was changed to 0.034 g/m$^2$.

Sample 108 was prepared in the same manner as in Sample 104, except that the amount of compound (1) was changed to 0.024 g/m$^2$ and the amount of black colloidal silver in 2nd layer was changed to 0.3 g/m$^2$.

Sample 109 was prepared in the same manner as in Sample 107, except that Compound (1) in Sample 107 was replaced by the same weight of Compound (9), which is set forth above.

Sample 110 was prepared in the same manner as in Sample 107, except that each of the silver halides coated in 4th to 6th layers, in 8th and 9th layers and in 11th and 12th layers was increased to 1.16 times as much as that in Sample 107.

Sample 111 was prepared in the same manner as in Sample 107, except that each of the silver halides coated in 4th to 6th layers, in 8th and 9th layers and in 11th and 12th layers was increased to 1.08 times as much as that in Sample 107.

Sample 112 was prepared in the same manner as in Sample 107, except that Compound (1) in Sample 107 was replaced by the same weight of Compound A8, which is set forth above, in an emulsified dispersion state.

A solid fine grain dispersion of compound (1) and an emulsification dispersion of compound (A8) were prepared in the following manner.

(Preparation of solid fine grain dispersion of compound (1))

Compound (1) was handled in the form of a wet cake while avoiding drying thereof as effectively as possible. 15 g of a 5% aqueous solution of carboxymethylcellulose was added per 2.5 g of dry solid contents so that the total weight became 63.3 g. The mixture was well agitated, thereby obtaining a slurry. The slurry together with 100 mL of glass beads of 0.8 to 1.2 mm in diameter was put in a disperser (sand grinder mill 1/16 G manufactured by Aimex) and dispersed for 12 hr. Water was added so that the concentration of the infrared absorbing dye became 2%, thereby obtaining an infrared absorbing dye dispersion.

(Preparation of emulsification dispersion of infrared absorbing dye AB)

| | |
|---|---|
| Liquid (1): | |
| infrared absorbing dye A8 | 60.0 g |
| dibutyl phthalate | 62.8 g |
| tricresyl phosphate | 62.8 g |
| ethyl acetate | 333 g |
| Liquid (2): | |
| Gelatin | 94 g |
| water | 581 mL |
| 5% aq. soln. of sodium dodecylbenzenesulfonate | 65 mL |

The liquid (1) was heated at 60° C. for 50 min to thereby effect a dissolution. A dissolution was separately effected in the liquid (2), and the liquid (2) was added to the liquid (1). The resultant mixture was agitated at 1500 r.p.m. for 15 min by means of a high speed agitator while maintaining the temperature of the mixture at 60° C. After the completion of the agitation, 2 g of methyl p-hydroxybenzoate and 6 lit. of water were added and the temperature of the mixture was raised to 40° C. Thereafter, the whole was concentrated to 2 kg with the use of ultrafilter labo module ACP 1050 manufactured by Asahi Chemical Co., Ltd. 1 g of F-17 was added, thereby obtaining an infrared absorbing dye emulsion.

(Evaluation of photographic property change during running processing)

Each of the above prepared samples was worked into size 135 (24 exposures) in accordance with ISO 1007:1995 (E) and accommodated in the magazine for size 135 (cartridge) prepared in accordance with ISO 1007:1995 (E). The obtained magazine was charged in a 35 mm compact camera "Cardiamini Tiara", with which a seemingly standard object was photographed. A running test was conducted with the use of an automatic developing machine until the cumulative replenished quantity of color developing replenisher became thrice the quantity of the color developing solution (mother liquor).

Each sample was subjected to wedge exposure with white light prior to and after the running test and developed by the automatic developing machine.

A density measurement was conducted, and the sensitivity was expressed by the logarithm of inverse number of exposure amount giving a density of the lowest density part of magenta dye image+1.0.

The photographic property change by the running was expressed by (sensitivity after running test)−(sensitivity before running test).

The smaller this value, the smaller the photographic property change by running.

In Table 2, set forth below, the difference between the sensitivity change of yellow dye image and the sensitivity change of cyan dye image is also set forth in parenthesis.

(Evaluation of preservability)

Each sample wound into a patrone was allowed to stand still at 40° C./80% for 5 days. The preservability was evaluated by a change of sensitivity of yellow dye image before and after the storage.

(Sensitivity by exposure from back side)

Each prepared sample was wedge exposed with white light from the side (back side) of the support opposite to the light-sensitive layer coated side (no exposure from the surface) and developed through the following steps.

A density measurement was conducted, and the sensitivity from the back side was expressed by the logarithm of inverse number of exposure amount giving a density of the lowest density part of cyan dye image+0.1.

Table 2 lists values relative to that of sample 101.

TABLE 2

| Sample No. | 1. Infrared absorbing dye<br>2. The place of addition<br>3. Amount<br>4. Others, if any | Absorbance at 950 nm | Amount of silver coated, in terms of silver g/m$^2$ | Preservability of the light-sensitive material | Change in photographic property by running processing | Sensitivity from the back side | Remarks |
|---|---|---|---|---|---|---|---|
| 101 | 1. Not added | 1.65 | 2.86 | +0.02 | −0.09<br>(+0.04) | Control | Comp. |
| 103 | 1. Not added<br>4. Instead of the dye, black colloidal silver was added to 1st layer (0.12 g/m$^2$) | 1.95 | 2.98 | +0.02 | −0.01<br>(+0.01) | −0.37 | Comp. |
| 104 | 1. Compound (1) in a state of solid fine grains<br>2. 1st layer<br>3. 0.009 g/m$^2$ | 1.76 | 2.86 | +0.02 | −0.05<br>(+0.01) | −0.01 | Inv. |
| 105 | 1. Compound (1) in a state of solid fine grains<br>2. 1st layer<br>3. 0.017 g/m$^2$ | 1.85 | 2.86 | +0.02 | −0.03<br>(+0.01) | −0.02 | Inv. |
| 106 | 1. Compound (1) in a state of solid fine grains<br>2. 1st layer<br>3. 0.027 g/m$^2$ | 1.96 | 2.86 | +0.02 | −0.01<br>(±0.00) | −0.03 | Inv. |
| 107 | 1. Compound (1) in a state of solid fine grains<br>2. 1st layer<br>3. 0.034 g/m$^2$ | 2.05 | 2.86 | +0.02 | −0.01<br>(±0.00) | −0.04 | Inv. |
| 108 | 1. Compound (1) in a state of solid fine grains<br>2. 1st layer<br>3. 0.024 g/m$^2$<br>4. The amount of black colloidal silver in 2nd layer: 0.3 g/m$^2$ | 2.05 | 2.91 | +0.02 | −0.01<br>(±0.00) | −0.19 | Inv. |
| 109 | 1. Compound (9) in a state of solid fine grains<br>2. 1st layer<br>3. 0.034 g/m$^2$ | 2.05 | 2.86 | +0.02 | −0.01<br>(±0.00) | −0.03 | Inv. |
| 110 | 1. Compound (1) in a state of solid fine grains<br>2. 1st layer<br>3. 0.034 g/m$^2$<br>4. silver halides in 4th to 6th, 8th to 11th and 11th to 12th layers were increased to 1.16 times | 2.15 | 3.30 | +0.03 | −0.03<br>(+0.03) | +0.01 | Comp. |
| 111 | 1. Compound (1) in a state of solid fine grains | 2.10 | 3.10 | +0.02 | −0.01<br>(±0.00) | ±0.00 | Inv. |

TABLE 2-continued

| Sample No. | 1. Infrared absorbing dye<br>2. The place of addition<br>3. Amount<br>4. Others, if any | Absorbance at 950 nm | Amount of silver coated, in terms of silver g/m$^2$ | Preservability of the light-sensitive material | Change in photographic property by running processing | Sensitivity from the back side | Remarks |
|---|---|---|---|---|---|---|---|
| | 2. 1st layer<br>3. 0.034 g/m$^2$<br>4. The amount of silver halides in 4th to 6th, 8th to 11th and 11th to 12th layers were increased to 1.08 times | | | | | | |
| 112 | 1. Compound A8 in a state of emulsified dispersion<br>2. 1st layer<br>3. 0.034 g/m$^2$ | 2.05 | 2.86 | +0.02 | −0.01 (±0.00) | −0.02 | Inv. |

It is apparent from Table 2 that when the infrared transmission density is low, continuation of the running processing causes a sensitivity drop.

The reason therefor would be that the automatic developing machine did not detect the sensitive material, so that the replenishment in specified quantity could not be effected.

This problem would be resolved by an increase of the amount of black colloidal silver. However, the sensitivity by the exposure from the back side would lower. Thus, for example, photographing of a date and time would be difficult.

On the other hand, when the infrared absorbing dye is added, the sensitivity drop during the running processing and the drop of the sensitivity from the back side would favorably be avoided.

Moreover, although an improving effect is recognized when the transmission density at 950 nm is at least 1.7, it is seen that the transmission density is more preferably at least 1.9.

Example 2

Samples 201 and 203 to 212 were prepared and evaluated in the same manner as in Example 1 except that the cellulose triacetate used as the support was replaced by a PEN (polyethylene naphthalate) of the same thickness. The similar results as in Example 1 were obtained.

Example 3

Samples 301 and 303 to 312 were prepared in the same manner as Samples 201 and 203 to 212 of Example 2 except that the thickness of the PEN support was changed to 98 $\mu$m and that the coated film was worked into size 220 in accordance with ISO 732:1991 (E) and wound into a spool prepared in accordance with ISO 732:1991 (E). These sample films were each charged into a medium size camera "Fuji Film GA645 Professional". Photographing was conducted therewith and the same evaluation as in Example 1 was made. The similar results as in Example 1 were obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A silver halide color photographic light-sensitive material having at least one red-sensitive silver halide emulsion layer, at least one green-sensitive silver halide emulsion layer, at least one blue-sensitive silver halide emulsion layer and at least one nonlight-sensitive hydrophilic colloid layer containing black colloidal silver, on a support, wherein said light-sensitive material contains a dye whose maximum absorption in the wavelength range of 400 nm to 1100 nm is given at a wavelength in an infrared region of 700 nm to 1100 nm; the amount of silver in said light-sensitive material is 3.2 g/m$^2$ or less in terms of silver; and said light-sensitive material has a transmission density of 1.7 or more at 950 nm.

2. The light-sensitive material according to claim 1, wherein said dye is contained in a form of dispersed solid fine grains.

3. The light-sensitive material according to claim 2, wherein said dye is represented by general formula (I):

(I)

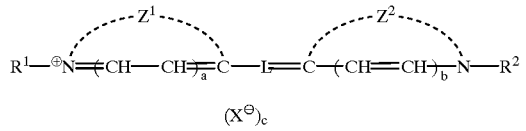

wherein $Z^1$ and $Z^2$ each independently represent nonmetallic atom groups forming five-membered or six-membered nitrogen-containing heterocycles which may undergo ring condensation; $R^1$ and $R^2$ independently represents an alkyl group, an alkenyl group or an aralkyl group; L represents a connecting group in which 5, 7 or 9 methine groups are bonded with each other so that the double bonds conjugate with each other; a, b and c each independently represents 0 or 1; and X represents an anion.

4. The light-sensitive material according to claim 3, wherein said cyanine dye that is represented by general formula (I) is represented by general formula (Ib):

(Ib)

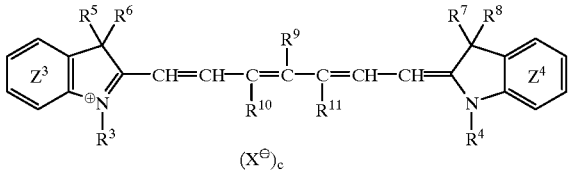

wherein another benzene ring may be fused with each of the benzene rings having $Z^3$ or $Z^4$ attached thereto inside the same; each of $R^3$ and $R^4$ independently represents an alkyl group, an aralkyl group or an alkenyl group; either each of $R^5$, $R^6$, $R^7$ and $R^8$ independently represents an alkyl group, or either $R^5$ and $R^6$ or $R^7$ and $R^8$ are bonded with each other, forming a five-membered or six-membered ring together with C; $R^9$ represents a hydrogen atom, an alkyl group, a halogen atom, an aryl group, —$NR^{14}R^{15}$ (wherein $R^{14}$ represents an alkyl group or an aryl group and $R^{15}$ represents a hydrogen atom, an alkyl group, an aryl group, an alkylsulfonyl group, an arylsulfonyl group or an acyl group, or $R^{14}$ and $R^{15}$ are bonded with each other to form a five-membered or six-membered nitrogen-containing heterocycle together with N), an alkylthio group, an arylthio group, an alkoxy group or an aryloxy group; $R^{10}$ and $R^{11}$ are independently hydrogen atoms or bonded with each other to form a five-membered or six-membered ring together with C═C—C; X represents an anion; and c represents 0 or 1.

5. The light-sensitive material according to claim 3, wherein said cyanine dye that is represented by general formula (I) is represented by general formula (Ic):

(Ic)

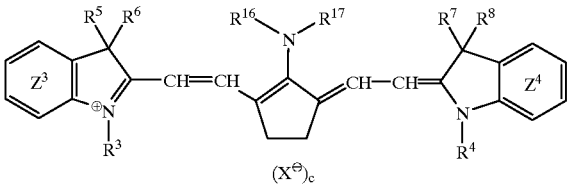

wherein another benzene ring may be fused with each of the benzene rings having $Z^3$ or $Z^4$ attached thereto inside the same; each of $R^3$ and $R^4$ independently represents an alkyl group, an aralkyl group or an alkenyl group; either each of $R^5$, $R^6$, $R^7$ and $R^8$ independently represents an alkyl group, or either $R^5$ and $R^6$ or $R^7$ and $R^8$ are bonded with each other to form a ring; each of $R^{16}$ and $R^{17}$ independently represents an alkyl group or an aryl group; X represents an anion; and c represents 0 or 1.

6. The light-sensitive material according to claim 2, wherein said dye is a lake cyanine dye represented by general formula (II):

$$(D)\text{-}A_m.Y_n \qquad (II)$$

wherein D represents the skeleton of cyanine dye represented by general formula (Ia):

(Ia)

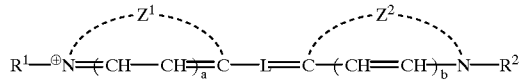

wherein $Z^1$ and $Z^2$ each independently represent nonmetallic atom groups forming five-membered or six-membered nitrogen-containing heterocycles together with $^+N{=}(CH{-}CH)_a{=}C$ and $C{-}(CH{=}CH)_b{-}N$, respectively, which heterocycles may undergo ring condensation; each of $R^1$ and $R^2$ independently represents an alkyl group, an alkenyl group or an aralkyl group; L represents a connecting group in which 5, 7 or 9 methine groups are bonded with each other so that the double bonds conjugate with each other; and each of a and b independently represents 0 or 1;

A represents an anionic dissociation group bonded with D as a substituent; Y represents a cation; m represents an integer of 2 to 5; and n represents an integer of 1 to 5 required for a charge balance.

7. The light-sensitive material according to claim 2, wherein said dye is represented by general formula (1):

(1)

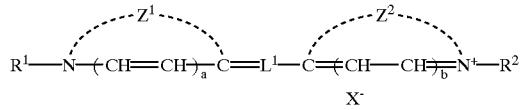

wherein $Z^1$ and $Z^2$ each represent nonmetallic atom groups required to form a five-membered or six-membered nitrogen-containing heterocycles together with $N(-CH{=}CH)_a-C$ and $C(=CH-CH)_b{=}N^+$, respectively, which heterocycles may undergo ring condensation; each of $R^1$ and $R^2$ represents an alkyl group, an alkenyl group or an aralkyl group; $L^1$ represents a connecting group resulting from linking of 7, 9 or 11 methine groups through conjugated double bonds; each of a and b represents 0 or 1; and X represents an anion.

8. The light-sensitive material according to claim 2, wherein said dye is represented by general formula (2):

(2)

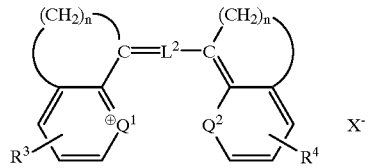

wherein each of $Q^1$ and $Q^2$ represents an oxygen atom or a sulfur atom; each of $R^3$ and $R^4$ represents a hydrogen atom, an alkyl group or an aryl group; $L^2$ represents a connecting group resulting from linking of 3 or 5 methine groups through conjugated double bonds; n represents 2 or 3; and X represents an anion.

9. The light-sensitive material according to claim 2, wherein said dye is represented by general formula (3):

(3)

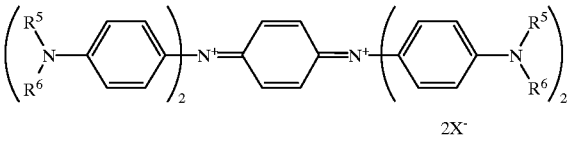

Wherein each of $R^5$ and $R^6$ represents an alkyl group, and X represents an anion.

10. The light-sensitive material according to claim 1, wherein said dye is represented by general formula (I):

(I)

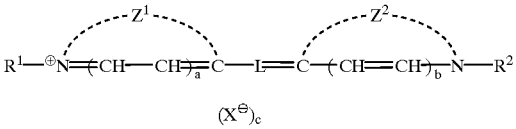

wherein $Z^1$ and $Z^2$ each independently represent nonmetallic atom groups forming five-membered or six-membered nitrogen-containing heterocycles which may undergo ring condensation; $R^1$ and $R^2$ independently represents an alkyl group, an alkenyl group or an aralkyl group; L represents a connecting group in which 5, 7 or 9 methine groups are bonded with each other so that the double bonds conjugate with each other; a, b and c each independently represents 0 or 1; and X represents an anion.

11. The light-sensitive material according to claim 10, wherein said cyanine dye that is represented by general formula (I) is represented by general formula (Ib):

(Ib)

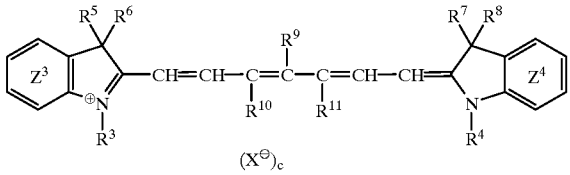

wherein another benzene ring may be fused with each of the benzene rings having $Z^3$ or $Z^4$ attached thereto inside the same; each of $R^3$ and $R^4$ independently represents an alkyl group, an aralkyl group or an alkenyl group; either each of $R^5$, $R^6$, $R^7$ and $R^8$ independently represents an alkyl group, or either $R^5$ and $R^6$ or $R^7$ and RB are bonded with each other, forming a five-membered or six-membered ring together with C; $R^9$ represents a hydrogen atom, an alkyl group, a halogen atom, an aryl group, $-NR^{14}R^{15}$ (wherein $R^{14}$ represents an alkyl group or an aryl group and $R^{15}$ represents a hydrogen atom, an alkyl group, an aryl group, an alkylsulfonyl group, an arylsulfonyl group or an acyl group, or $R^{14}$ and $R^{15}$ are bonded with each other to form a five-membered or six-membered nitrogen-containing heterocycle together with N), an alkylthio group, an arylthio group, an alkoxy group or an aryloxy group; $R^{10}$ and $R^{11}$ are independently hydrogen atoms or bonded with each other to form a five-membered or six-membered ring together with C═C—C; X represents an anion; and c represents 0 or 1.

12. The light-sensitive material according to claim 10, wherein said cyanine dye that is represented by general formula (I) is represented by general formula (Ic):

(Ic)

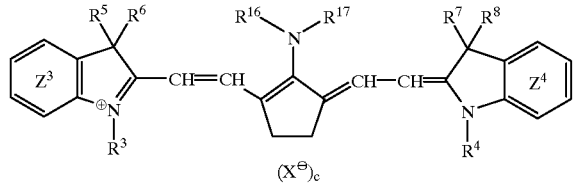

wherein another benzene ring may be fused with each of the benzene rings having $Z^3$ or $Z^4$ attached thereto inside the same; each of $R^3$ and $R^4$ independently represents an alkyl group, an aralkyl group or an alkenyl group; either each of $R^5$, $R^6$, $R^7$ and $R^8$ independently represents an alkyl group, or either $R^5$ and $R^6$ or $R^7$ and $R^8$ are bonded with each other to form a ring; each of $R^{16}$ and $R^{17}$ independently represents an alkyl group or an aryl group; X represents an anion; and c represents 0 or 1.

13. The light-sensitive material according to claim 10, wherein $Z^1$ and $Z^2$ are each 5-membered nitrogen-containing heterocycles.

14. The light-sensitive material according to claim 10, wherein said nitrogen-containing heterocycles and condensed rings therefrom are selected from the group consisting of an oxazole ring, an isoxazole ring, a benzoxazole ring, a naphthoxazole ring, an indolenine ring, a benzindolenine ring, an imidazole ring, a benzimidazole ring, a naphthimidazole ring, a quinoline ring, a pyridine ring, a pyrrolopyridine ring, a furopyrrole ring, an indolizine ring, an imidazoquinoxaline ring and a quinoxaline ring.

15. The light-sensitive material according to claim 10, wherein $R^1$ and $R^2$ are independently an alkyl group having 1 to 10 carbon atoms, an alkenyl group having 2 to 10 carbon atoms, or an aralkyl group having 7 to 12 carbon atoms.

16. The light-sensitive material according to claim 10, wherein L represents a connecting group in which 7 methine groups are bonded with each other.

17. The light-sensitive material according to claim 10, wherein a and b are each 0 and c is 1.

18. The light-sensitive material according to claim 10, wherein X is selected from the group consisting of halide ions, p-toluenesulfonate ion, ethyl sulfate ion, $PF_6^-$, $BF_4^-$, and $ClO_4^-$.

19. The light-sensitive material according to claim 1, wherein said dye is a lake cyanine dye represented by general formula (II):

$$(D)\text{-}A_m.Y_n \quad \text{(II)}$$

wherein D represents the skeleton of cyanine dye represented by general formula (Ia):

(Ia)

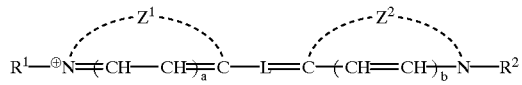

wherein $Z^1$ and $Z^2$ each independently represent nonmetallic atom groups forming five-membered or six-membered nitrogen-containing heterocycles together with $^+N{=}(CH{-}CH)_a{=}C$ and $C{-}(CH{=}CH)_b{-}N$, respectively, which heterocycles may undergo ring condensation; each of $R^1$ and $R^2$ independently represents an alkyl group, an alkenyl group or an aralkyl group; L represents a connecting group in which 5, 7 or 9 methine groups are bonded with each other so that the double bonds conjugate with each other; and each of a and b independently represents 0 or 1;

A represents an anionic dissociation group bonded with D as a substituent; Y represents a cation; m represents an integer of 2 to 5; and n represents an integer of 1 to 5 required for a charge balance.

20. The light-sensitive material according to claim 1, wherein said dye is represented by general formula (1):

(1)

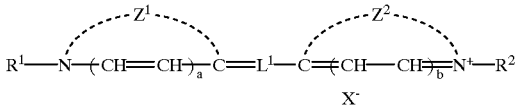

wherein $Z^1$ and $Z^2$ each represent nonmetallic atom groups required to form a five-membered or six-membered nitrogen-containing heterocycles together with $N(—CH=CH)_a—C$ and $C(=CH—CH)_b=N^+$, respectively, which ab heterocycles may undergo ring condensation; each of $R^1$ and $R^2$ represents an alkyl group, an alkenyl group or an aralkyl group; $L^1$ represents a connecting group resulting from linking of 7, 9 or 11 methine groups through conjugated double bonds; each of a and b represents 0 or 1; and X represents an anion.

21. The light-sensitive material according to claim 1, wherein said dye is represented by general formula (2):

(2)

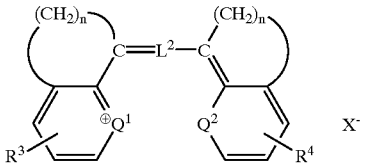

wherein each of $Q^1$ and $Q^2$ represents an oxygen atom or a sulfur atom; each of $R^3$ and $R^4$ represents a hydrogen atom, an alkyl group or an aryl group; $L^2$ represents a connecting group resulting from linking of 3 or 5 methine groups through conjugated double bonds; n represents 2 or 3; and X represents an anion.

22. The light-sensitive material according to claim 1, wherein said dye is represented by general formula (3):

(3)

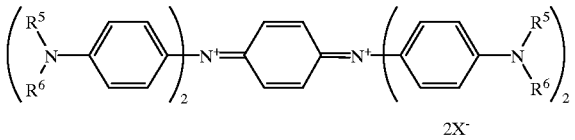

wherein each of $R^5$ and $R^6$ represents an alkyl group, and X represents an anion.

* * * * *